United States Patent [19]

Kutsukake et al.

[11] Patent Number: 4,923,846

[45] Date of Patent: May 8, 1990

[54] HEAT TRANSFER SHEET FOR COLOR IMAGE FORMATION

[75] Inventors: Masaki Kutsukake, Chofu; Jumpei Kanto, Komae, both of Japan

[73] Assignee: Dai Nippon Insatsu Kabushiki Kaisha, Japan

[21] Appl. No.: 143,947

[22] PCT Filed: Apr. 30, 1987

[86] PCT No.: PCT/JP87/00269

§ 371 Date: Dec. 17, 1987

§ 102(e) Date: Dec. 17, 1987

[87] PCT Pub. No.: WO87/06533

PCT Pub. Date: Nov. 5, 1987

[30] Foreign Application Priority Data

Apr. 30, 1986 [JP] Japan ..... 61-97972
Apr. 30, 1986 [JP] Japan ..... 61-97973
Apr. 30, 1986 [JP] Japan ..... 61-97974

[51] Int. Cl.[5] ..... B41M 5/035; B41M 5/26

[52] U.S. Cl. ..... 503/227; 8/471; 428/195; 428/913; 428/914

[58] Field of Search ..... 8/470, 471; 427/146, 427/256; 428/195, 913, 914; 430/200, 201, 945; 503/227

[56] References Cited

U.S. PATENT DOCUMENTS 4,700,207 10/1987 Vanier et al. ..... 503/227

*Primary Examiner*—Bruce H. Hess
*Attorney, Agent, or Firm*—Arnold, White & Durkee

[57] ABSTRACT

The present invention relates to a heat transfer sheet for color image formation comprising dye carrying layers (*2a, 2b, 2c*) formed on a substrate sheet (1) and respectively having hues of cyan, magenta and yellow. The characteristic feature of this heat transfer sheet resides in a combination of the dye carrying layers with the respective hues having the following color characteristics as evaluated according to the Graphic Arts Technical Foundation:

cyan—a hue error of from 10 to 45% and a turbidity of 35% or less or a hue error of from 45 to 60% and a turbidity of 20% or less;

magenta—a hue error of from 10 to 35% and a turbidity of 25% or less or a hue error of from 35 to 60% and a turbidity of 10% or less; and yellow—a hue error of 10% or less and a turbidity of 10% or less.

15 Claims, 17 Drawing Sheets

HEAT TRANSFER SHEET FOR COLOR IMAGE FORMATION

TECHNICAL FIELD

This invention relates to a heat transfer sheet for color image formation, more particularly to a heat transfer sheet for color image formation having broad and excellent color reproducibility similar to various color printing or color photography which has been used commercially widely in the prior art.

BACKGROUND ART

A large amount of color printing has been practiced in the art by way of off-set printing, gravure printing, etc. In carrying out such color printing, an original manuscript as it is, or combined with another manuscript, letters, symbols, etc., is subjected to color resolution to prepare a plate of the three primary colors of cyan, magenta, yellow, and further a plate of black is added if desired, to reproduce the hue, the pattern, etc., of the manuscript with the respective printing inks.

As the color material of the three primary color inks of cyan, magenta and yellow in such a printing system, pigments have been used in most cases, and these pigments are selected from the most preferable pigments of the three primary colors based on a large number of experiences in the past so that the three primary colors as a matter of course, and the intermediate colors therebetween could be all reproduced broadly.

Since printing systems of the prior art as described above always require indispensably preparation of the plate with the three primary colors or with further addition of black, there arises a problem in that a high expenditure for installation and much space are required. For example, there is a problem in that color printing cannot be performed simply in small factories or offices.

On the other hand, with the development of photographic technology in recent years, color photography has been greatly utilized, but reproduction of these color photographies are not as easy as printing, and there is also the drawback that this reproduction becomes expensive as the size becomes greater.

As one method for solving such problems, a heat transfer system for formation of color image in which a heat transfer sheet of the three primary colors is prepared from sublimatable (or heat migratable) dyes, and the dyes are transferred by heat energy by utilizing this heat transfer sheet to form a color image has been proposed. Such a system, which requires no great printing machine or other various auxiliary equipment and makes possible formation of a color image easily, is expected to be developed in the future.

The above heat transfer system is a method in which a heat transferable material (image receiving sheet) and a heat transfer sheet are superposed on one another, and heat energy is imparted by a printing means such as a thermal head from either side, thereby transferring the dyes on the heat transfer sheets onto the heat transferable sheet, and the size of the color dots formed by this transfer is very much greater than those of the dots in off-set printing of the prior art. Also, in the case of printing ink, the color density of the dot can be freely changed principally by the size of the dot, while in the case of heat transfer sheets the dot size cannot be easily changed, and the difference in density cannot but be changed by the heat energy imparted, but the delicate change in density by this method is very difficult.

From the difference between the two systems as described above, when a color image is to be formed by the heat transfer system, the scope of its color reproducibility is remarkably inferior as compared with the color image formed by off-set printing, etc., and improvement in this respect has been desired.

Also, the colors of the three colors of off-set printing ink of the prior art are constituted mostly of pigments, while the color materials to be used in the heat transfer sheet are all sublimatable (or heat migratable) dyes, and therefore the two are different from each other in their color forming mechanisms, whereby it has been substantially impossible to select heat migratable (sublimatable) dyes coinciding with the three primary colors of off-set printing ink.

Further, in the dyes of the prior art, when a color image is to be formed by use of the three primary colors of cyan, magenta and yellow, reproduction of the intermediate colors between these three colors has been extremely difficult, and for obtaining a color image approximating the printed image in the heat transfer system, it has been an important technical task to develop a heat transfer sheet having broad color reproducibility not only in the three primary colors but also in the intermediate colors therebetween.

DISCLOSURE OF THE INVENTION

The present invention has been accomplished in view of the problems of the prior art as described above, and it is intended to provide a heat transfer sheet for color image formation having excellent color reproducibility comparable with the color image by printing.

The heat transfer sheet for color image formation according to the present invention is a heat transfer sheet for color image formation comprising respective dye carrying layers containing dyes with respective hues of cyan, magenta and yellow formed on a substrate sheet, characterized in that said respective dye carrying layers each contain one kind or plural kinds of dyes, and the color characteristics of said respective dye carrying layers satisfy the conditions shown below as the color characteristics (based on GATF) under the state transferred on the image receiving sheet:

Cyan: hue error is in the range of from 10% on the green side to 60% on the blue side, and turbidity is 35% or less in the range of hue error from 10% on the green side to 45% on the blue side, and turbidity is 20% or less in the range of hue error from 45% to 60% on the blue side;

magenta: hue error is in the range of from 10% on the blue side to 60% on the red side, and turbidity is 25% or less in the range of hue error from 10% on the blue side to 35% on the red side, and turbidity is 10% or less in the range of hue error from 35% to 60% on the red side;

yellow: hue error is in the range of from 10% on the red side to 10% on the green side, and turbidity in this range is 10% or less.

BEST MODES FOR PRACTICING THE INVENTION

In the following, constitutions and preferred embodiments of the heat transfer sheet for color image formation according to the present invention are described in more detail.

Figure 1:
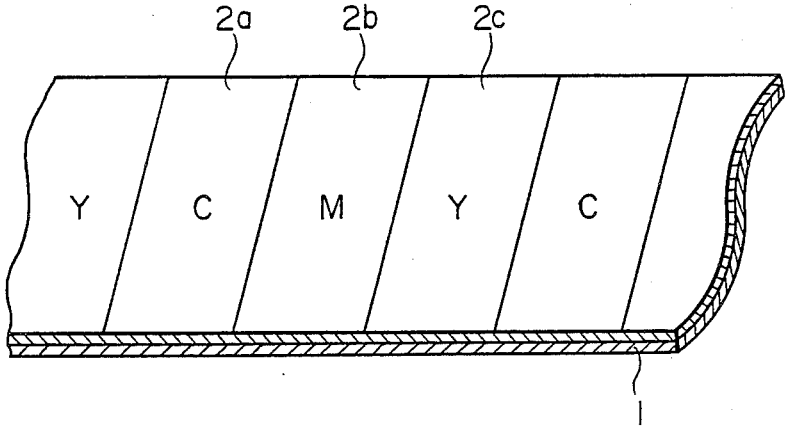
FIG. 1 is a perspective view showing the appearance of the heat transfer sheet for color image formation according to a preferred embodiment of the present invention.
Figure 2:
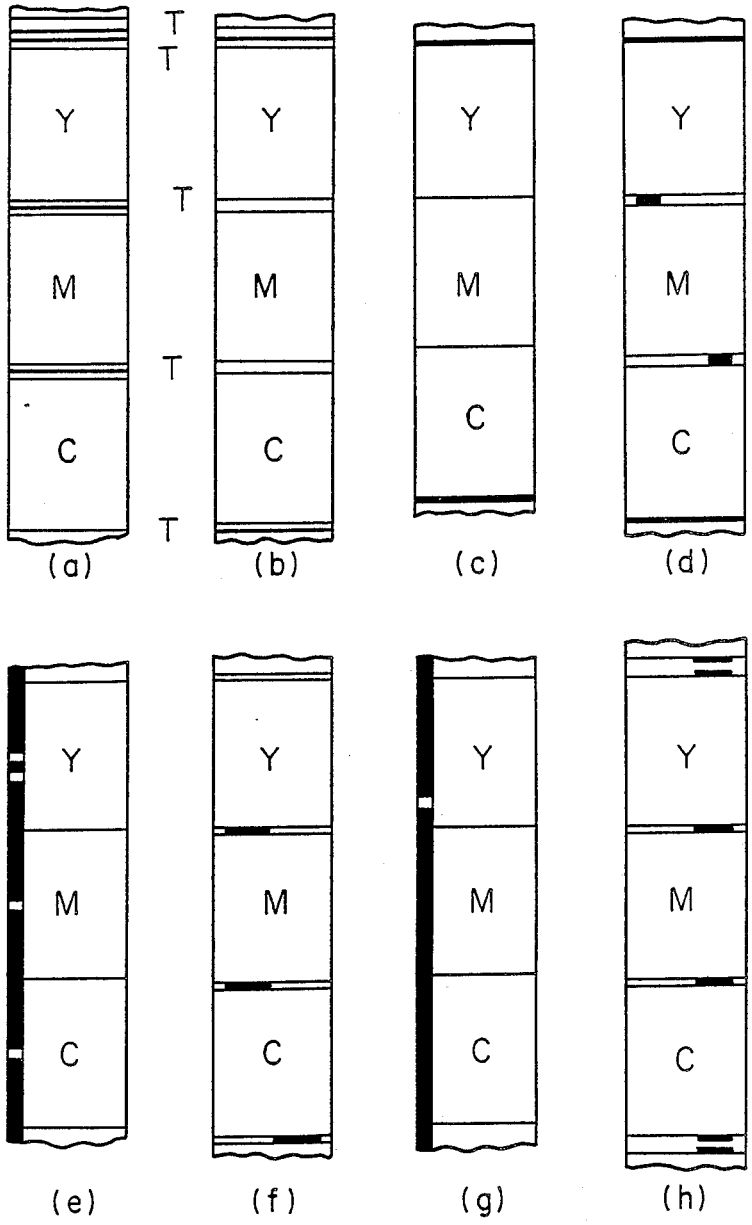
FIGS. 2 to 5 are fragmentary views showing examples of detection marks which can be imparted to the heat transfer sheet in shape of continuous sheet of the present invention. In the Figures, C indicates cyan color, M magenta color, Y yellow color, Bk black color, and T detection mark.
Figure 3:
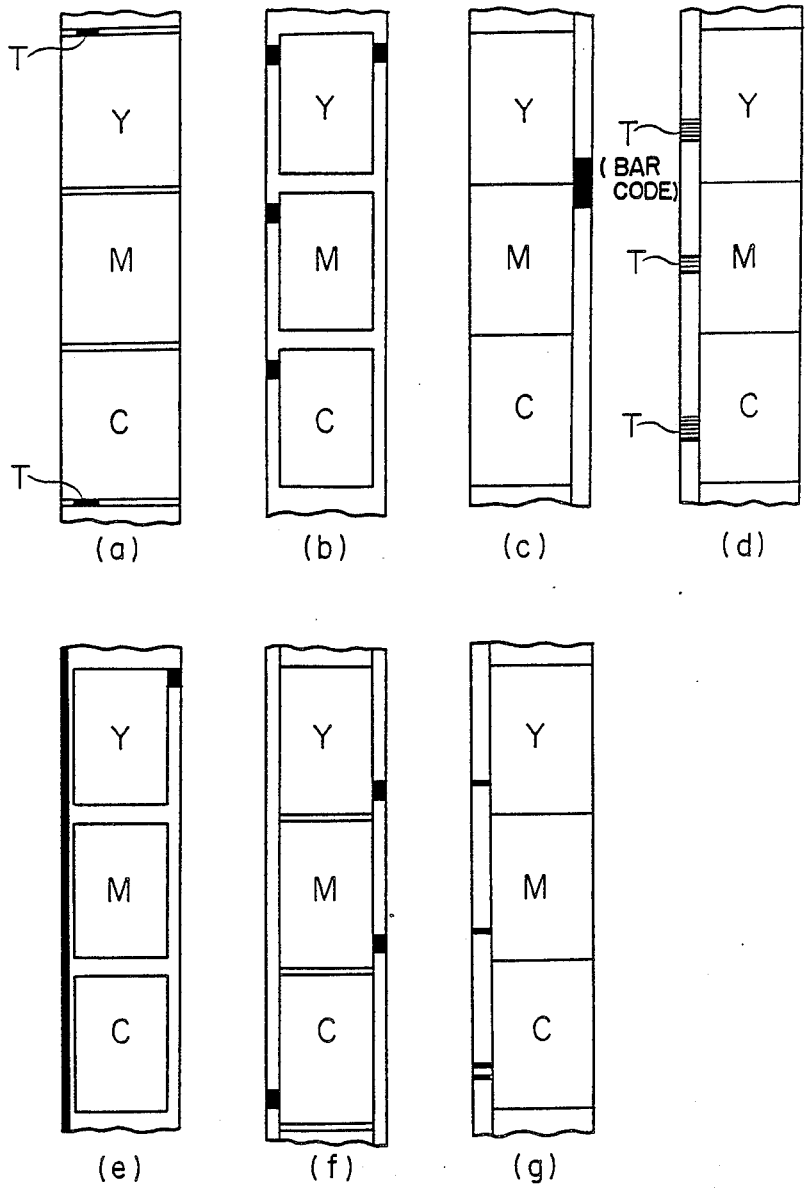
Figure 4:
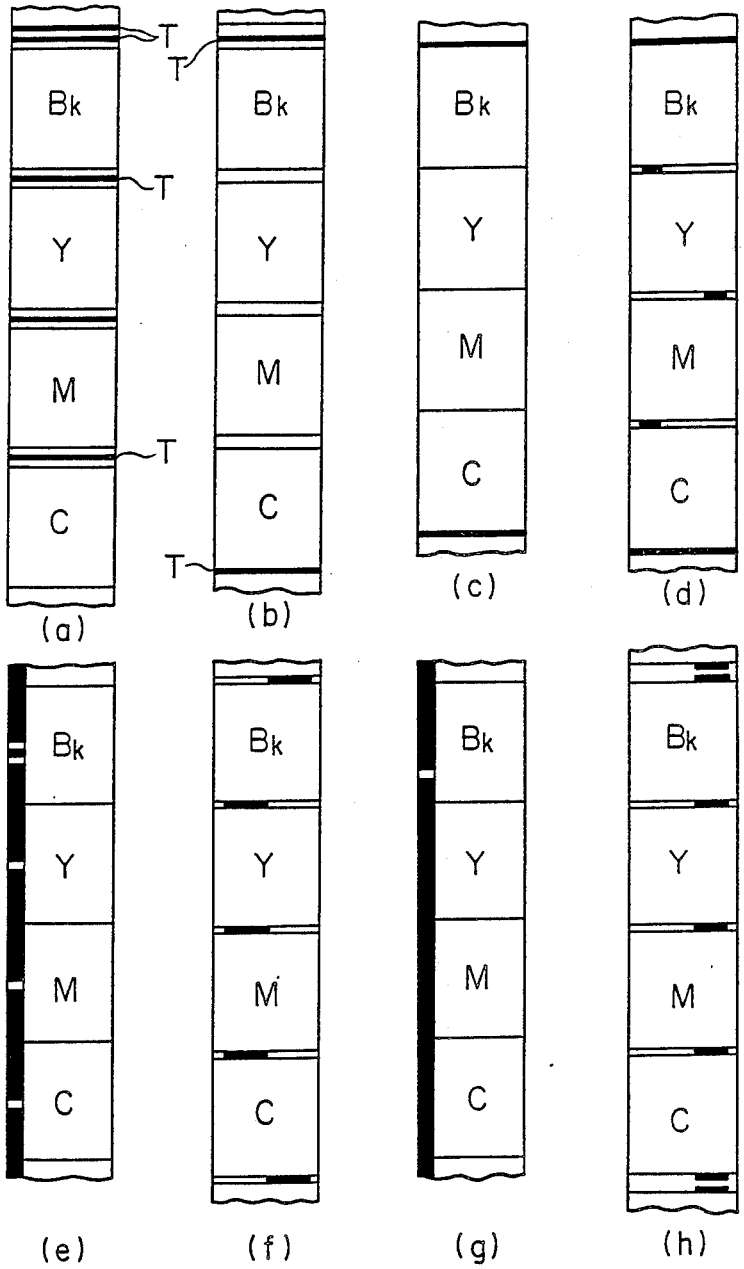
Figure 5:
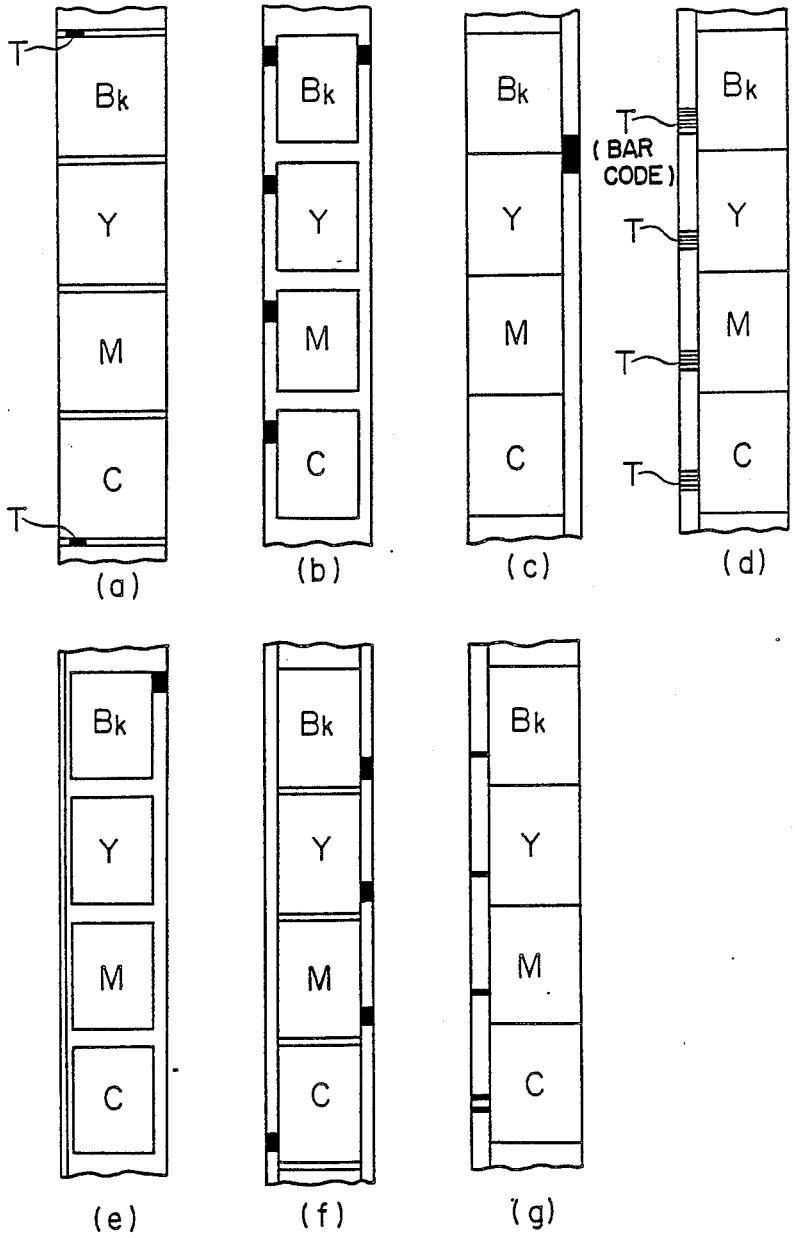

The heat transfer sheet for color image formation according to the present invention, as shown in the perspective view in FIG. 1, is formed basically of the dye carrying layers *2a*, *2b* and *2c* of the respective hues of cyan (C), magenta (M), and yellow (Y), respectively in any desired order on a substrate sheet 1. Also in the present invention, although not shown in the Figures, in addition to the above three primary colors, a dye carrying layer with another hue such as black, etc., may be also formed. Further, in the heat transfer sheet for color image formation of the present invention, the respective dye carrying layers may be formed separately on a plural number of substrate sheets.

In the present invention, the above respective dye carrying layers each contain one kind or plural kinds of dyes, and the color characteristics of the respective dye carrying layers are characterized by satisfying the following conditions under the state transferred on the image receiving sheet:

cyan: hue error is in the range of from 10% on the green side to 60% on the blue side, and turbidity is 35% or less in the range of hue error from 10% on the green side to 45% on the blue side, and turbidity is 20% or less in the range of hue error from 45% to 60% on the blue side;

magenta: hue error is in the range of from 10% on the blue side to 60% on the red side, and turbidity is 25% or less in the range of hue error from 10% on the blue side to 35% on the red side, and turbidity is 10% or less in the range of hue error from 35% to 60% on the red side;

yellow: hue error is in the range of from 10% on the red side to 10% on the green side, and turbidity in this range is 10% or less.

In the present invention, by selecting the combination of dyes so that the color characteristics of the respective colors will have the values within the hue ranges as specified above, color heat transferred image with excellent color reproducibility can be obtained. Specific kinds and combinations of the dyes preferably used in the present invention are described below.

Generally speaking, in heat transfer recording, various hues necessary in forming a color image are obtained as a mixture detractively obtained of the material colors created by inherent absorptions of the respective dyes by the presence of the respective colors mixed at any desired ratio on the heat transferable sheet. In this case, if the color characteristics of the three colors of cyan, magenta and yellow are not within the range restricted in the present invention, the intermediate colors by mixing of these three colors become turbid color with low chroma, whereby no good color reproducibility can be obtained.

However, according to the above heat transfer sheet of the present invention, good color reproducibility comparable with off-set printing can be obtained.

The values of the above hue error and turbidity are values obtained following the evaluation method of GATF (Graphic Arts Technical Foundation). The evaluation method of the color characteristics is a method in which color characteristics are evaluated by judgement of deviation of the ideal color of the process ink from the practical color of the ink to be measured by use of the density values obtained by three kinds of filters of blue, green and red coinciding with spectral characteristics of the processing, and it is the evaluation method broadly used in the field of printing. In this method, density value is calculated from the reflectance of the measured light when passing through the filter, and when the lowest density is made L (Low), the highest value H (High) and the middle value M (Middle) the hue error and the turbidity can be calculated from the following equations:

$$\text{Hue error} = \frac{M - L}{H - L} \times 100(\%)$$

$$\text{Turbidity} = \frac{L}{H} \times 100(\%)$$

As to details about the above evaluation method of color characteristics, they are described in, for example, GATF-Bulletin 509 "Color Separation Photography" and GATF research report (No. 38), "Color Material" (58-[5]293-301, 1985).

The above hue error and turbidity can be indicated by a color circle in accordance with GATF standard. On the basis of this indication method, the hue error is indicated in the circumferential direction while the turbidity is indicated by the distance from the outer periphery toward the center of the circle, and the closer to the center, the higher becomes the turbidity as is shown, for example, in FIG. 7.

With respect to the hue error, for instance, in the case of cyan, the hue error can sift from the starting point 0% toward the blue side (magenta side) or conversely toward the green side (yellow side) depending upon the color component having the density value M defined above. For example, if the color component of the cyan having the value M (the color component of the second high density) is the magenta component, the hue error of the cyan sifts from 0% toward the magenta side (blue side) by the % value calculated.

In the present invention, in selecting the dyes, in addition to the above hue conditions, it is preferable to bear in mind the physical properties possessed by the dyes such as inorganic/organic values (I/O values), molecular weights, melting points, etc., of the dyes. In the following, these points are explained.

Generally speaking, in the heat transfer method employing sublimatable dyes, development of a heat transfer sheet which can give clear images with sufficient density and yet with the images formed exhibiting excellent various fastness, by imparting heat energy within a very short time, it is strongly desired under the present circumstances.

In the prior art, various disperse dyes have been used as the dyes for the sublimation transfer system, but since rapid sublimation speed is required in the sublimation transfer system, those having generally molecular weights of about 300 or less or at most 350 or less have been limited in use.

However, those having such relatively low molecular weights have good transfer speed and color formation characteristic, but they can produce only images with low migration resistance and low contamination resistance.

We have studied in detail the known disperse dyes which were entirely out of selection for the sublimation transfer method of the prior art, and their adaptability for heat transfer from the standpoint that not only sublimatability or gasifiability of the dye, but also thermal migratability of dye is important when the heat transfer sheet can be sufficiently contacted with the image receiving sheet as described above, and consequently found that, particularly for cyan and magenta, even those with molecular weights of 300 or more, or 350 or more, and further 390 or more which have been considered in the prior art entirely useless practically have excellent heating migratability to the extent which cannot be considered from common sense in the prior art in the dyes with the value of I/O value of the dye according to the definition shown below, further that excellent dyeability, color formability onto image receiving sheet are exhibited, and moreover that no migrating characteristic (bleeding property) and contamination of the dye can be seen in the transferred transferable material, thus having extremely ideal properties as the dye for heat transfer sheet.

The "I/O value" as mentioned in the present invention follows "organic Conceptual Diagram—Base and Application—" (Sankyo Shuppan) written by Yoshio Koda.

Thus, in the present invention, by restricting the above I/O value, the dyes with relatively high molecular weights which have been considered as being useless in the prior art as the dyes for sublimation transfer can be used, and therefore a heat transfer sheet also having excellent storability can be obtained.

Also, referring to the melting point of the dye, the dye to be used in the present invention may have a melting point which is within the range of 250° C. or higher, more preferably 80° to 20° C. In the present invention, it is preferable to select optimum dyes within the above range particularly in view of the solubility of the dye.

Specific examples of preferable dyes which can be used in the present invention are mentioned below.

DYE FOR FORMATION OF CYAN COLOR

1. Structural formula:

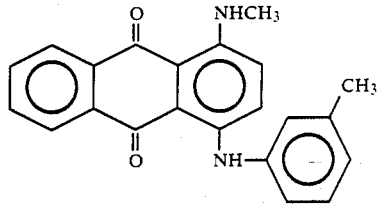

Color index (C.I. No.): Solvent Blue 63.
Molecular weight: 342.
I/O value: 0.89.
m.p.: 148.5° C.
Color characteristic (based on GATF):
hue error 21.3%
turbidity 31.7%

2. Structural formula:

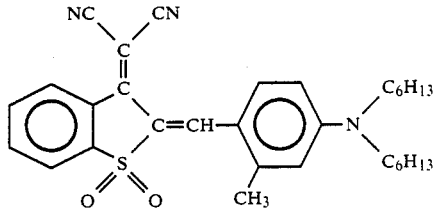

Molecular weight: 515.1.
I/O value: 0.52.
m.p.: 132°-135° C.
Color characteristic (based on GATF):
hue error 25.5%,
turbidity 9.2%

3. Structural formula:

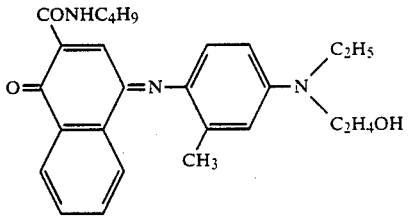

Molecular weight: 433.
I/O value: 1.12.
m.p.: 127°-130° C.
Color characteristic (based on GATF):
hue error 1.0%
turbidity 26.1%

4. Structural formula:

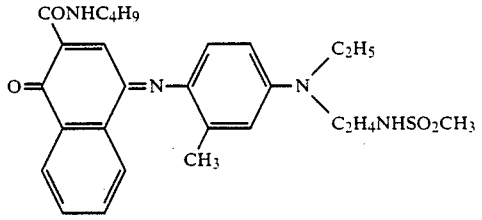

Molecular weight: 510.1.
I/O value: 1.30.
m.p.: 176°-179° C.
Color characteristic (based on GATF):

hue error 9.08%
turbidity 23.9%
5. Structural formula:

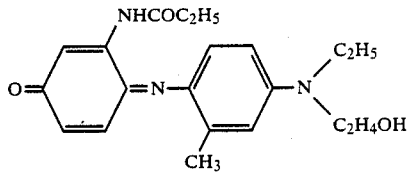

Molecular weight: 355.
I/O value: 1.28.
m.p.: 148°-150° C.
Color characteristic (based on GATF):
hue error 31.8%,
turbidity 20.7%
6. HM-1354 (trade name), produced by Mitsui Toatsu K.K.
Molecular weight: 396.
m.p.: 181°-183° C. (decomposed).
Color characteristic (based on GATF):
hue error 15.8%,
turbidity 23.1%
7. Structural formula:

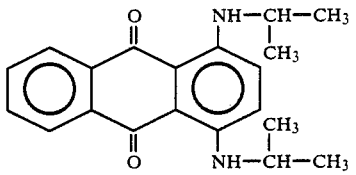

Color index (C.I. No.): Solvent Blue 36.
Molecular weight: 322.
I/O value: 0.99.
m.p.: 162°-164° C.
Color characteristic (based on GATF):
hue error 39.4%
turbidity 13.5%
8. Structural formula:

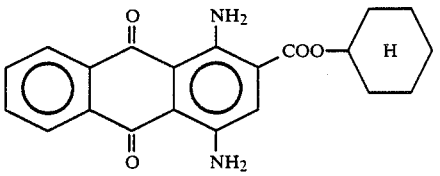

m.p.: 148°-150° C.
I/O value: 1.06.
Color characteristic (based on GATF):
hue error 52.4%,
turbidity 14.2%

DYE FOR FORMATION OF MAGENTA COLOR

1. Structural formula:

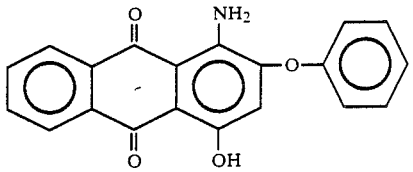

Color index (C.I. No.): Disperse Red 60.
Molecular weight: 331.
I/O value: 1.10.
m.p.: 182° C.
Color characteristic (based on GATF):
hue error 31.8%
turbidity 5.3%
2. Structural formula:

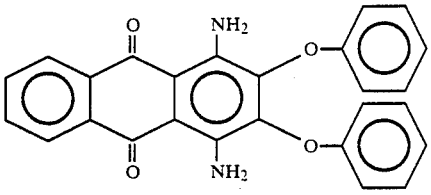

Color index (C.I. No.): Disperse Violet 26.
Molecular weight: 422.
I/O value: 0.86.
m.p.: 182° C.
Color characteristic (based on GATF):
hue error 3.1%
turbidity 15.1%
3. Structural formula:

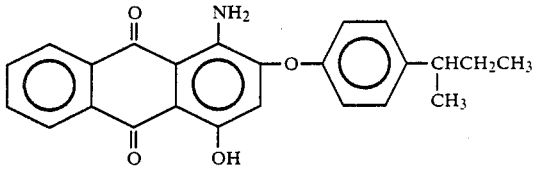

Color index (C.I. No.):
Molecular weight: 387.
I/O value: 0.92.
m.p.: 134°-135° C.
Color characteristic (based on GATF):
hue error 28.0%,
turbidity 3.7%
4. Structural formula:

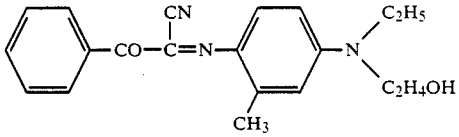

Color index (C.I. No.):
Molecular weight: 335.
I/O value: 1.05.
Color characteristic (based on GATF):
hue error 23.9%,
Turbidity 10.2%
5. Structural formula:

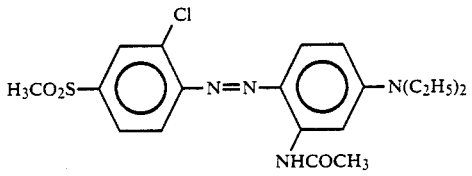

Color index (C.I. No.): Disperse Red 210.
Molecular weight: 422.5.
I/O value: 1.11.
m.p.: 154°-157° C.
Color characteristic (based on GATF):
hue error 56.5%,
turbidity 5.2%

6. Structural formula:

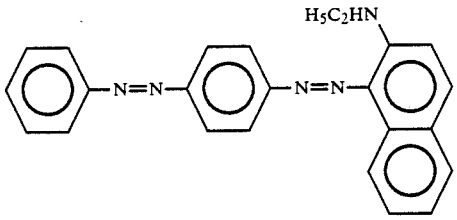

Color index (C.I. No.): Solvent Red 19.
Molecular weight: 379.
I/O value: 0.46.
m.p.: 132°-134° C.
Color characteristic (based on GATF):
hue error 22.1%,
turbidity 19.1%

7. Polanil Red 3GL (produced by BASF Co.)
Color index (C.I. No.): Disperse Red 224.
m.p.: 105°-107° C.
Color characteristic (based on GATF):
hue error 55.1%,
turbidity 4.5%

8. Structural formula:

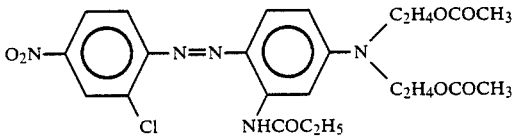

Color index (C.I. No.): Disperse Red 167.
Molecular weight: 519.45.
m.p.: 107°-109° C.
Color characteristic (based on GATF):
hue error 37.1%
turbidity 7.9%

DYE FOR FORMATION OF YELLOW COLOR

1. Structural formula: Foron Brilliant Yellow S-6GL (produced by Sandoz Co.)

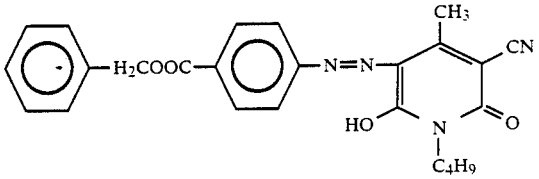

Molecular weight: 444.
I/O value: 0.85.
m.p.: 148.9° C.
Color characteristic (based on GATF):
hue error 1.1%,
turbidity 2.6%

2. Structural formula: PTY-52 (produced by Mitsubishi Kasei Co.)

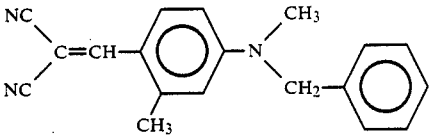

Color index (C.I. No.): Disperse Yellow 141.
Molecular weight: 287.
I/O value: 0.58.
m.p.: 151°-153° C.
Color characteristic (based on GATF):
hue error 1.0%
turbidity 1.9%

3. Macrolex Yellow 6G (produced by Bayer)
Color index (C.I. No.): Disperse Yellow 201.
m.p.: 105°-107° C.
Color characteristic (based on GATF):
hue error 1.9%,
turbidity 6.6%

The values of the color characteristics as described here were measured by preparing a dye ink with the following composition, making a heat transfer sheet and a heat transferable sheet similarly as in Example C-1 as described below, performing heat transfer, followed by measurement of the image by a reflective densitometer, Macbeth RD-918) and calculation according to the evaluation method of GATF as mentioned above.

| Dye ink composition | |
|---|---|
| Dye | 3 parts |
| Polyvinylacetal resin | 3 parts |
| Methyl ethyl ketone | 47 parts |
| Toluene | 47 parts |

DYE FOR FORMATION OF BLACK COLOR

1. Structural formula:

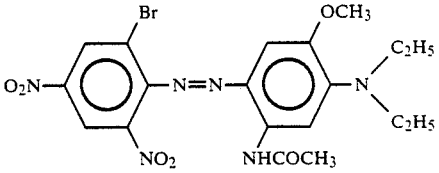

Molecular weight: 508.9.
I/O value: 0.86.

m.p.: 138.5°-139.5° C.

2. Dye name: Waxoline Blue AP-FW (produced by ICI)

Structural formula:

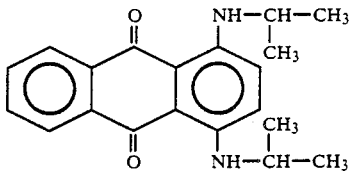

Color index (C.I. No.): Solvent Blue 36.

Molecular weight: 322.

I/O value: 0.99.

m.p.: 162.5°-163.5° C.

3. Structural formula:

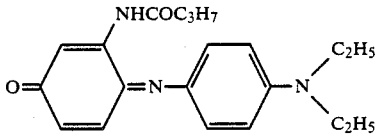

Molecular weight: 339.

I/O value: 1.15.

m.p.: 127°-128° C.

4. Dye name: DHK-996 (produced by Nippon Kagaku Kogyo Co.)

m.p.: 117°-118° C.

5. Dye name: Sumikalone Rubine SEGL (produced by Sumitomo Kagaku)

Structural formula:

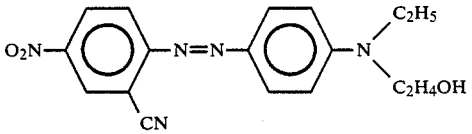

Color index No.: Disperse Red 73.

Molecular weight: 348.

I/O value: 0.72.

m.p.: 139°-140° C.

6. Dye name: Ceres Red 7B (produced by Bayer)

Structural formula:

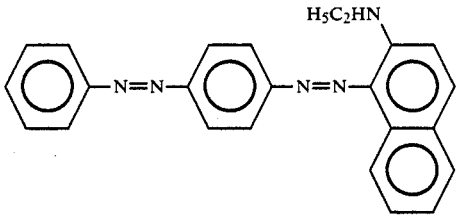

Color index No.: Solvent Red 19.

Molecular weight: 379.

I/O value: 0.46.

m.p.: 132.5°-133.5° C.

7. Dye name: Foron Brilliant Yellow S-6GL (produced by Sandoz)

Structural formula:

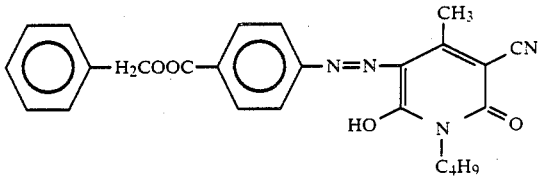

Molecular weight: 444.

I/O value: 0.85.

m.p.: 148.9° C.

8. Dye name: PTY-52 (produced by Mitsubishi Kasei Co.)

Structural formula:

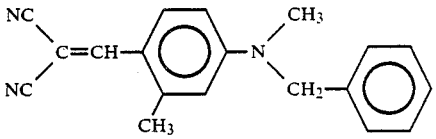

Color index No.: Disperse Yellow 141.

Molecular weight: 287.

I/O value: 0.58.

m.p.: 151.5°-152.5° C.

Otherwise, the azo dye 12 as described below and other dyes 35 can be used as the dye for formation of black color.

Next, of the above dyes, preferable combinations of the dyes for forming the respective hues will be described.

As a preferable embodiment of the present invention, for at least one color of the respective colors of cyan, magenta and yellow, specific two or more kinds of dyes are used in combination.

For example, as the cyan dye, the C.I. Solvent Blue 83 of the above cyan 1 and the dye shown by the above cyan 2 (either one can include dispersing agent, etc., hereinafter the same) can be combined and formed into a mixture preferably with the mixing ratio of the latter of 0.3 to 8.0 parts by weight per 1 part by weight of the former, whereby a tone corresponding to the cyan ink of off-set printing ink can be reproduced.

Alternatively, the dye represented by the above cyan 3 and the dye represented by the above cyan 2 can be combined as the cyan dye, and formed into a mixture preferably with the mixing ratio of 0.5 to 5.0 parts by weight of the latter per 1 part by weight of the former, whereby a tone corresponding to the cyan ink of the off-set printing ink can be reproduced.

On the other hand, as the magenta dye, the C.I. Disperse Red 60 of the above magenta 1 and C.I. Disperse Violet 26 of the above magenta 2 can be formed into a mixture preferably with the mixing ratio within the range of 0.3 to 1.0 parts by weight of the latter per 1 part by weight of the former, whereby a tone corresponding to the magenta ink of off-set printing ink can be reproduced.

Alternatively, as the magenta dye, the dye represented by the above magenta 3 and C.I. Disperse Violet 26 of the above magenta and the dye represented by the above yellow 1 can be combined, and formed into a mixture preferably with the ratio with the mixing ratio within the range of 0.05 to 1.0 part by weight of the magenta 2 and 0.02 part by weight or less of yellow 1 per 1 part of the magenta 3, whereby a tone corresponding to the magenta ink of off-set printing ink can be reproduced.

Further, as the yellow dye, the dye represented by the above yellow 1 and C.I. Disperse Red 210 of the above magenta 5 can be formed into a mixture preferably with a mixing ratio of 0.02 parts by weight of the latter per 1 part by weight of the former, whereby a tone corresponding to the magenta ink of off-set printing ink can be reproduced.

The important specific feature in the above embodiment of the invention is the point that, even if the individual dyes to be combined themselves may be outside the above range defined of the color characteristics of the present invention, provided that the combination is within the range defined in the present invention, an excellent broad color reproduction of the intermediate color is rendered possible during formation of the color image with these three colors.

In the present invention, a heat transfer sheet satisfying the conditions of specific color characteristics as described above can be obtained by the dyes and their combinations. By referring to the dyes, those having specific I/O values and molecular weights as described above are preferably used. Calling attention on this point, preferable specific examples of the heat migratable dyes having the above physical properties include the following compounds.

(I) Dyes represented by the following formula (I) and/or (II)

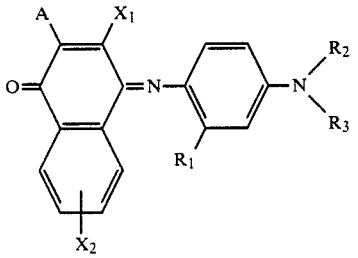

(I)

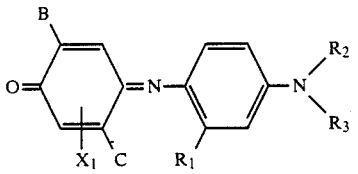

(II)

In the above formula, A is hydrogen atom, —CONHR$_4$ (R$_4$ is hydrogen atom or alkyl group), (R$_5$ is amino group or acylamino group),

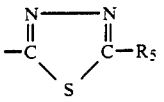

—COCH$_2$COR$_6$ (R$_6$ is alkyl group or

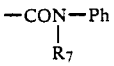

(R$_7$ is hydrogen atom or alkyl group), X$_1$ and X$_2$ are hydrogen atoms or halogen atoms, R$_1$ is hydrogen atom or alkyl group, R$_2$ and R$_3$ are alkyl groups or substituted alkyl groups, B and C are hydrogen atoms, —CONHR$_4$, —COR$_6$, —COOR$_6$, amino group, alkylamino group or acylamino group.

Such dyes per se are known materials and can be obtained according to the oxidative coupling method of P-phenylenediamine compound and naphthols or phenols, and have been used in the prior art primarily as the cyan color forming agent of color photography.

Particularly preferable dyes of the above formula (I) or (II) in the present invention were found to be those in which A and B are —CONHR$_4$, R$_4$ is C$_1$–C$_6$ alkyl group and R$_1$ is hydrogen or methyl group.

Also, concerning R$_2$ and R$_3$, those in which each is C$_1$–C$_4$ alkyl group and at least one of R$_2$ and R$_3$ is a water-insoluble polar group such as hydroxyl group or substituted hydroxyl group [e.g. —O—R′ (R′ is lower alkyl group, alkylcarbonyl group, etc.)], amino group or substituted amino group [e.g. —NH—R″ (R″ is alkyl group, alkylcarbonyl group, alkylsulfonyl group, etc.)], cyano group, nitro group, etc., were found to give best results, that is, excellent migration resistance, etc., simultaneously with excellent sublimatability, dyeability to the substrate sheet, heat resistance, and color forming property during transfer.

(II) Azo type dyes

Particularly preferable compounds are exemplified by those having the following structures.

1.

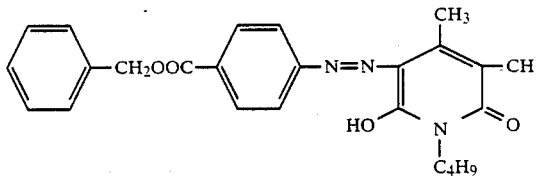

(MW = 444, I/O = 0.84)

2.

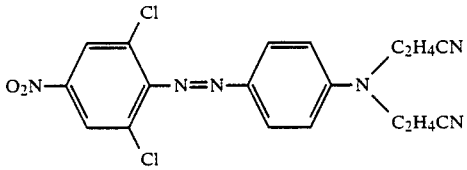

(MW = 417, I/O = 0.65)

-continued
3.
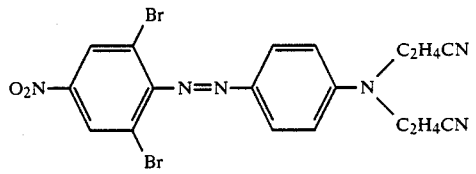
(MW = 505.8, I/O = 0.61)
4.
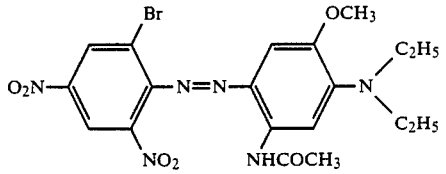
(MW = 508.9, I/O = 0.88)
5.
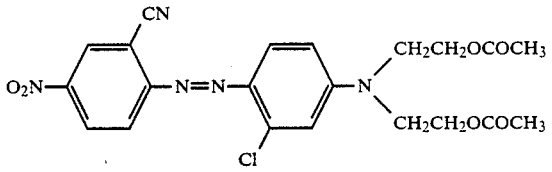
(MW = 473.5, I/O = 0.73)
6.
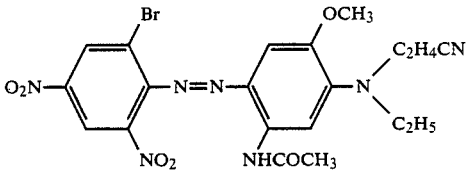
(MW = 533.9, I/O = 0.92)
7.
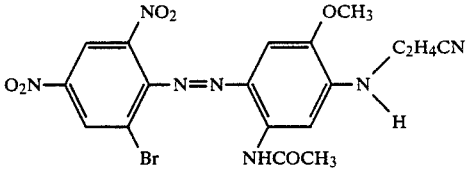
(MW = 505.9, I/O = 0.98)
8.
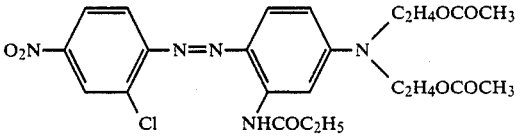
(MW = 519.5, I/O = 0.93)
9.
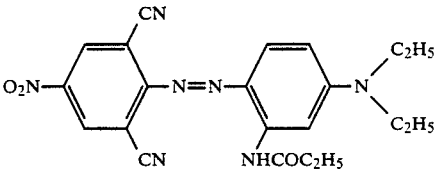
(MW = 419, I/O = 1.02)
10.
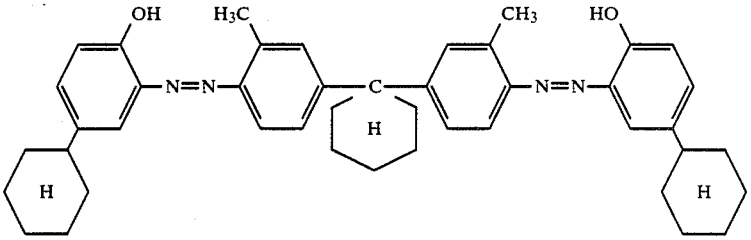
(MW = 869, I/O = 0.39)

-continued

11.

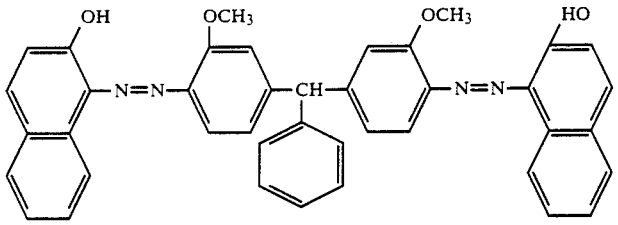

(MW = 644, I/O = 0.57)

12.

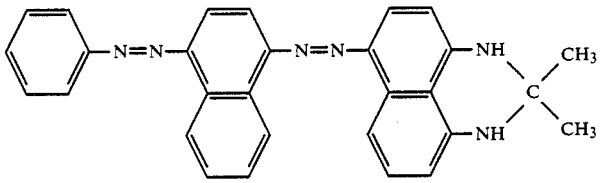

(MW = 456, I/O = 0.59)

SOLVENT BLACK 3

(III) Anthraquinon type dyes

Particularly preferable compounds are exemplified by those having the following structures:

13.

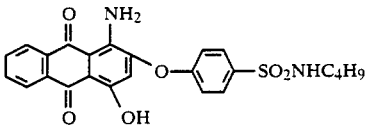

(MW = 466, I/O = 1.42)

14.

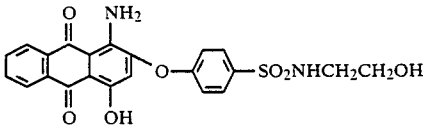

(MW = 454, I/O = 1.77)

15.

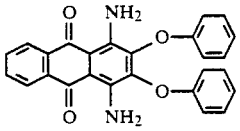

(MW = 422, I/O = 0.86)

16.

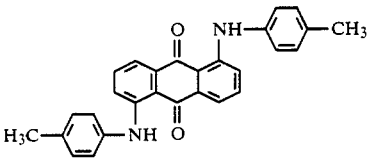

(MW = 418, I/O = 0.72)

17.

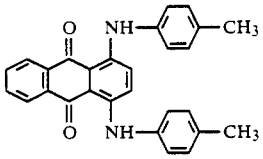

(MW = 418, I/O = 0.72)

-continued

18.

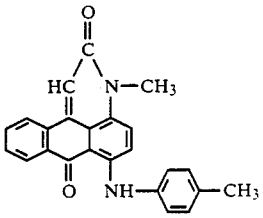

(MW = 366, I/O = 0.83)

19.

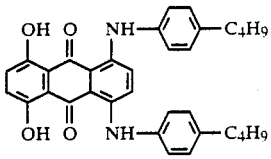

(MW = 534, I/O = 0.89)

20.

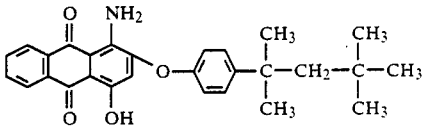

(MW = 443, I/O = 0.81)

21.

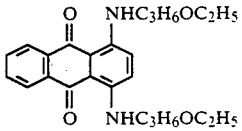

(MW = 410, I/O = 0.88)

(IV) Imide anthraquinone type dyes represented by the following formula (III)

(III)

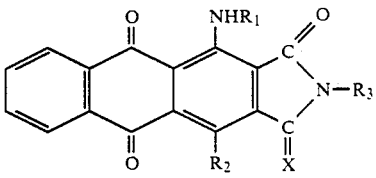

In the above formula, $R_1$ represents hydrogen atom or $C_1$–$C_{20}$ alkyl group, $R_2$ represents hydrogen atom, amino group or $C_1$–$C_{20}$ alkyl-substituted amino group, X represents O or NH group, and $R_3$ represents $C_1$–$C_{20}$ alkyl group, and said alkyl group may have hydroxyl group, $C_1$–$C_{20}$ alkoxy group or $C_2$–$C_{20}$ alkoxy group having $R_4$—O— group (where $R_4$ is hydrogen atom or $C_1$–$C_{20}$ alkyl group).

Particularly preferable compounds are exemplified by those having the following structures.

22.

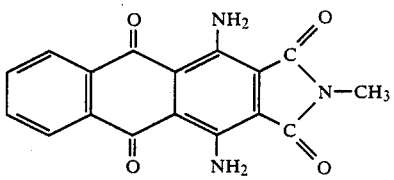

(MW = 321, I/O = 1.72)

23.

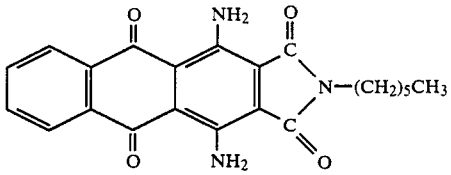

(MW = 391, I/O = 1.33)

24.

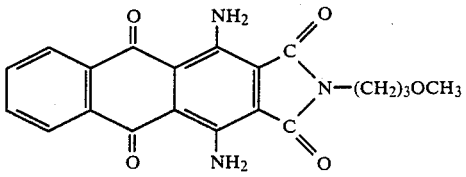

(MW = 379, I/O = 1.51)

25.

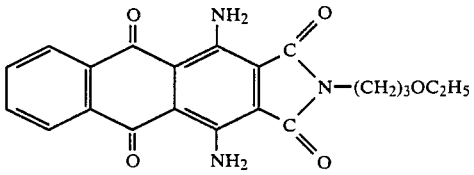

(MW = 393, I/O = 1.44)

26.

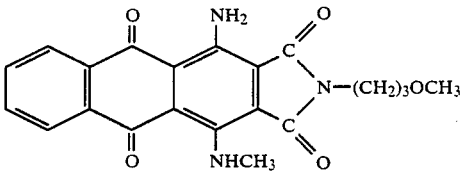

(MW = 393, I/O = 1.44)

27.

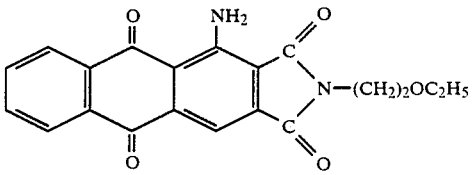

(MW = 364, I/O = 1.34)

28.

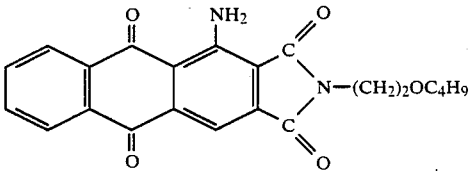

(MW = 392, I/O = 1.22)

-continued

29.

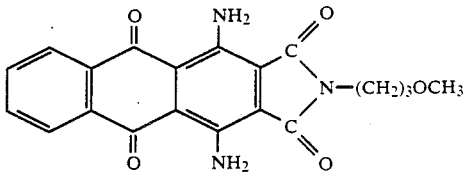

(MW = 379, I/O = 1.51)

30.

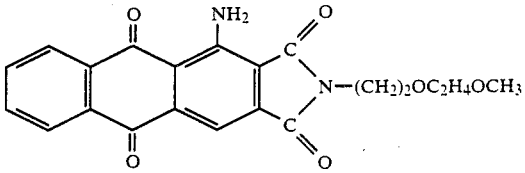

(MW = 394, I/O = 1.32)

(V) Other dyes

Particularly preferable dyes may include the following dyes:

31.

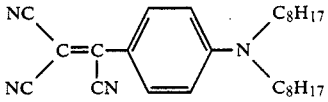

(MW = 418, I/O = 0.34)

32.

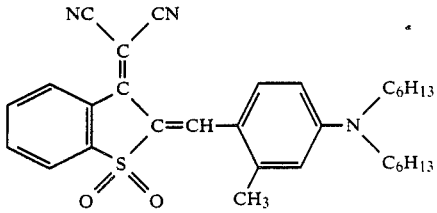

(MW = 515, I/O = 0.52)

33.

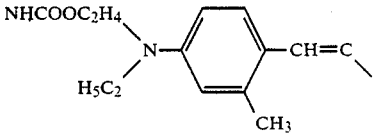

(MW = 374, I/O = 0.98)

34.

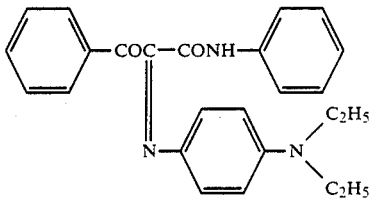

(MW = 399, I/O = 0.90)

35.

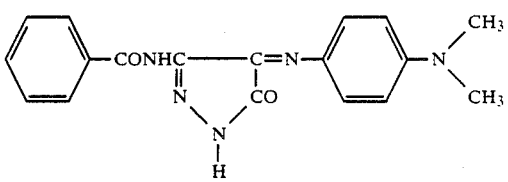

(MW = 334, I/O = 1.63)

Of the dyes as exemplified above and dyes available in the present invention other than the above examples, preferable dyes are those having I/O values of 1.40 or less, more preferably 1.00 or less, and molecular weights of about 280 or more, more preferably 350 or more, most preferably 390 to 800. If the I/O value exceeds 2.30, the melting point of the dye becomes remarkably high, and also solubility in a solvent and affinity for heat transferable material will be abruptly lowered. On the other hand, with a dye having a molecular weight less than 280, various drawbacks of the prior art cannot be sufficiently solved, while with a dye having a molecular weight in excess of 800, heat transfer speed and color forming characteristic will become undesirably inferior.

The present invention provides a heat transfer sheet of the three colors of cyan, magenta and yellow color formation respectively by utilizing such a specific combination of dyes as described above, and the heat transfer sheets of these three colors may be respectively separate heat transfer sheets, or alternatively dye carrying layers containing the dyes of the three colors may be formed in any desired order on a continuous substrate sheet, and further any desired heat transfer sheet of black color formation known in the art may be combined with these embodiments.

Also, in the case of the above continuous sheet, any desired detection mark can be imparted corresponding to the part of the three colors (or four colors) on the continuous sheet so that the dye carrying layers of cyan, magenta, yellow (and black) can be read respectively by a printer. Examples of these detection search marks are shown in the accompanying drawing.

By use of a heat transfer sheet as described above, a color image with broad color reproducibility similar to color printing obtained by off-set printing or color photography, particularly with good color reproducibility of intermediate color can be formed, and therefore it has become possible to form a color image of extremely high quality without use of a printing system of the prior art which is expensive and takes space, for example, in a small factory in which no such large scale printing system can be employed, office, or even in a home.

A specific feature of the heat transfer sheet of the present invention is to use the three colors of a specific combination as described above, and other constitutions may be the same as the heat transfer sheet known in the art.

The substrate sheet to be used in the constitution of the heat transfer sheet of the present invention containing the dyes as described above may be any material known in the art having heat resistance and strength to some extent, for example, paper, various processed papers, polyester film, polystyrene film, polypropylene film, polysulfone film, polycarbonate film, polyvinyl alcohol film, and cellophane, particularly preferably polyester film, with a thickness of about 0.5 to 50 μm, preferably 1 to 10 μm.

The dye carrying layer provided on the surface of the substrate sheet as described above is a layer having the above dyes carried on any desired binder resin.

As the binder resin for carrying the above dyes, any resin known in the art can be used, and preferable examples include cellulose resins such as ethyl cellulose, hydroxyethyl cellulose, ethylhydroxy cellulose, hydroxypropyl cellulose, methyl cellulose, cellulose acetate, cellulose acetate butyrate, etc., vinyl resins such as polovyinyl alcohol, polyvinyl acetate, polyvinylbutyral, polyvinylacetal, polyvinylpyrrolidone, and polyacrylamide, and polyesters, which are preferred with respect to heat resistance, migration of dyes, etc.

The dye carrying layer of the heat transfer sheets of the present invention is formed basically of the above materials, but it can also include various additives similar to those known in the art, if desired.

Such a dye carrying layer is formed preferably by dissolving or dispersing the respective components of the respective combination of dyes as described above, the binder resin and other optional components in an appropriate solvent to form a coating solution or ink for formation of the carrying layer, applying this on the above substrate sheet, and then drying.

The carrying layer thus formed may have a thickness of about 0.2 to 5.0 μm, preferably 0.4 to 2.0 μm, and the above dyes in the carrying layer suitably exist in an amount of 5 to 70 wt. %, preferably 10 to 60 wt. % of the weight of the carrying layer.

The heat transfer sheet of the present invention as described above is sufficiently useful as such for heat transfer, but a tack preventive layer, namely, a mold release layer may be further provided on the surface of the dye carrying layer, and by providing such a layer, tack between the heat transfer sheet and the heat transferable material during heat transfer can be prevented, whereby a further higher heat transfer temperature can be used to form an image with higher density.

As such a mold release layer, a considerable effect can be exhibited only by attachment of inorganic powder for tack prevention. Further, it can be formed by providing a mold release layer with a thickness of 0.01 to 5 μm, preferably 0.05 to 2 μm from a resin of excellent mold release property such as silicone polymer, acrylic polymer, and fluorinated polymer.

The inorganic powder or mold release polymer as mentioned above can exhibit sufficient effect even when included within the dye carrying layer.

Further, on the back surface of such a heat transfer sheet, a heat resistant layer may be provided for prevention of adverse influence from the heat of the thermal head.

As the transferable material (image receiving sheet) to be used for formation of image by use of the heat transfer sheet as described above, any material of which the recording surface has dye receptivity for the above dyes may be used, and in the case of paper, metal, glass, synthetic resin, etc., having no dye receptivity, a dye receptive layer may be formed on at least one surface thereof.

As the transferable material on which no dye receptive layer can be formed, for example, there may be included fibers, fabrics, films, sheets, molded product, etc., comprising polyolefin resins such as polypropylene, halogenated polymers such as polyvinyl chloride and polyvinylidene chloride, vinyl polymers such as polyvinyl acetate and polyacryl ester, polyester resins such as polyethylene terephthalate and polybutylene terephthalate, polystyrene resins, polyamide resins, copolymer resins of an olefin such as ethylene and propylene, with other vinyl monomers, ionomers, cellulose resins such as cellulose diacetate, and, polycarbonate.

Particularly preferable is a sheet or film comprising polyester or processed paper provided with a polyester layer. Also, even a non-dyeable transferable material such as paper, metal, glass or others, can be used as the transferable material by coating and drying a solution or a dispersion of a dyeable resin as described above on its recording surface, or laminating with such resin films.

Further, even in the case of a transferable material having dyeability as mentioned above, a dye receptive layer may be formed from a resin with even better dyeability on its surface similarly as in the case of paper as mentioned above.

The dye receptive layer thus formed can be formed from either a single or a plural number of materials, and also various additives within the range which does not interfere with the desired object can be included as a matter of course.

Such a dye receptive layer may have any desired thickness, but the thickness is generally 5 to 50 μm. Also, such a dye receptive layer is preferably a continuous coating, but it may be also formed as a discontinuous coating by the use of a resin emulsion or resin dispersion.

Such transferable material is basically as described above and can be sufficiently useful as such, but inorganic powder for prevention of tack can be included in the above heat transfer material or its dye receptive layer, and by doing so, tack between the heat transfer sheet and the heat transferable material can be prevented even when the temperature during heat transfer may be elevated, whereby further excellent heat transfer can be effected. Particularly preferable is fine powdery silica.

Also, in place of the inorganic powder such as silica as mentioned above, or in combination therewith, a resin as mentioned above with good mold release property may be added. Particularly preferable mold releasable polymers are cured products of silicone compounds, for example, cured products comprising epoxy-modified silicone oil and amino-modified silicone oil. Such a mold release agent may be added at a proportion comprising about 0.5 to 30 wt. % of the weight of the dye receptive layer.

Also, the transferable sheet to be used may enhance the tack preventive effect by attachment of the inorganic powder as mentioned above onto the surface of its dye receptive layer, or alternatively a layer comprising the mold release agent excellent in mold release property as mentioned above may be provided.

Such a mold release layer can exhibit satisfactory effect with a thickness of about 0.01 to 5 μm, whereby the dye receptivity can be further improved with prevention of tack between the heat transfer sheet and the dye receptive layer.

As means for imparting heat energy to be used in carrying out heat transfer by use of the heat transfer sheet of the present invention as described above and the recording medium as described above, any of the imparting means known in the art can be used. For example, by imparting heat energy of about 5 to 100 $mJ/mm^2$ by controlling the recording time by means of a recording device such as a thermal printer (e.g., video printer VY-100, produced by Hitachi Seisakusho K.K.), etc., the desired object can be sufficiently attained.

By use of the heat transfer sheet of the present invention as described above, as contrasted to various printing systems, particularly color printing according to off-set printing system which requires expensive installations and large space, and further as contrasted with color photography which was expensive for duplication of a large size, color image with extremely good color reproduction, particularly with excellent color reproducibility in intermediate color can be formed by a small size and relatively inexpensive device, even in small factory, office or home.

Further, by use of the heat transfer sheet of the present invention as described above, prior to practicing a large amount of color printing by various printing systems, particularly off-set printing system, color resolution of the original manuscript can be conducted by a color scanner, and a heat transfer recording device provided with a computer may be connected thereto to perform color printing as a substitute for correction printing, whereby corrections of colors of the printed matter, changes in lay-out, insertions of symbols, letters, and other original manuscript, etc., can be finally determined by processing in computer without preparation or correction of the printing plates corresponding to such changes. Accordingly, by preparation of the final plate under the state thus determined, cumbersome correction printing steps in the prior art can be simplified to a great extent.

The present invention is described in more detail by way of the following Examples, in which, parts or % are based on weight, unless otherwise particularly noted.

EXAMPLE A-1

The three kinds of ink compositions for formation of dye carrying layers with the following compositions were prepared. In the cyan and yellow ink compositions, insolubles were removed by dissolving the components before filtration. These were applied respectively on polyethylene terephthalate films of a thickness of 4.5 μm, the back surfaces of which had been subjected to heat-resistant treatment, in a dried coating amount of 1.0 $g/m^2$ and then dried to obtain respective heat transfer sheets of the three colors of cyan, magenta and yellow of the present invention.

| | |
|---|---|
| Cyan color | |
| Kayaset Blue 714 | 1.00 parts |
| Foron Brilliant Blue S-R (containing dispersing agent) | 4.80 parts |
| Polyvinylbutyral resin | 4.60 parts |
| Methyl ethyl ketone | 44.80 parts |
| Toluene | 44.80 parts |
| Magenta color | |
| MS Red G | 2.86 parts |
| Macrolex Red Violet R | 1.56 parts |
| Polyvinylbutyral resin | 4.32 parts |
| Methyl ethyl ketone | 43.34 parts |
| Toluene | 42.92 parts |
| Cyclohexanone | 5.0 parts |
| Yellow color | |
| Foron Brilliant Yellow S-6GL (containing dispersing agent) | 6.00 parts |
| Polybutyral resin | 4.52 parts |
| Methyl ethyl ketone | 43.99 parts |
| Toluene | 40.99 parts |
| Cyclohexanone | 4.50 parts |

Next, by use of a synthetic paper (YUPO FPG #150, produced by Oji Yuka) as the substrate sheet, a coating solution with the following coposition was applied on one surface of the paper in a quantity of 10 $g/m^2$ on drying and dried at 100° C. for 30 minutes to obtain a transferable material (image receiving sheet).

| | |
|---|---|
| Polyester resin (Vylon 200, produced by Toyobo) | 11.5 parts |
| Vinyl chloride-vinyl acetate copolymer (VYHH, produced by UCC) | 5.0 parts |
| Amino-modified silicone oil (KF-393, produced by Shinetsu Kagaku Kogyo) | 1.2 parts |
| Epoxy-modified silicone oil | 1.2 parts |

-continued

| | |
|---|---|
| (X-22-343, produced by Shinetsu Kagaku Kogyo) | |
| Methyl ethyl ketone/toluene/cyclohexanone (weight ratio 4:4:2) | 102 parts |

The heat transfer sheets of the three colors of the present invention as described above and the heat transferable material were respectively superposed on one another with each dye carrying layer and the dye receiving surface being opposed to each other, and recording with a thermal head was performed from the back surface of the heat transfer sheet under the conditions of a head application voltage of 10 V and a printing time of 4.0 msec. to obtain images of three colors. The color rendering properties of these images of three colors were compared with the corrected printed images with the standard colors of off-set printing ink (G set ink, produced by Moroboshi Ink), and good coincidence was confirmed.

EXAMPLE A-2

A heat transfer sheet for color image formation shaped in a continuous sheet of the present invention having the three colors juxtaposed successively on a continuous sheet was obtained as in Example A-1 except that the inks for formation of dye carrying layers of three colors were coated in the order of cyan, magenta and yellow respectively over a constant area on one sheet of a continuous sheet (the same substrate as in Example A-1).

Figure 6:
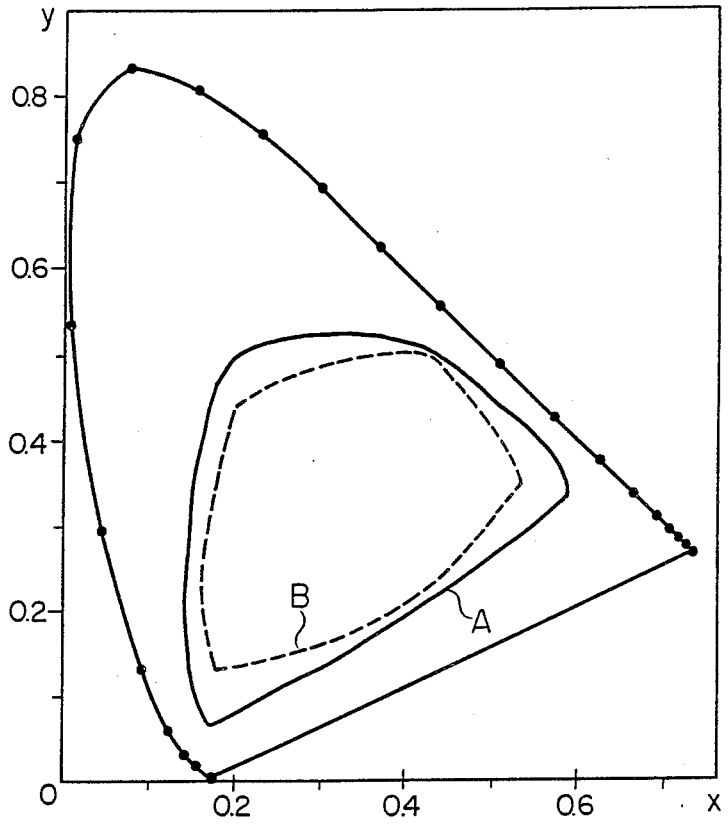
FIG. 6 is xy chromaticity diagram of CIE XYZ display system obtained by calorimetry by use of a color calorimeter CR 100 produced by Minorta of the color image (A) according to the present invention obtained in Example A-2 and the color image (B) by the standard off-set ink.

By the use of the heat transfer sheet, heat transfer was performed continuously as in Example A-1 in the order of cyan, magenta and yellow to form color images. On the other hand, for comparison, by use of the standard off-set ink (G set ink, produced by Moroboshi Ink), the color images were formed from the same original manuscript by a correction printer and compared with the above color images. As a result, discrimination was impossible by naked eye, and the color rendering properties of these two kinds of color images were as shown in FIG. 6.

As the above heat transfer sheet, a sheet having a black dye carrying layer formed thereon was also prepared. As the black ink composition, those shown in Table C-13 or C-16 shown below were employed.

EXAMPLE B-1

The three kinds of ink compositions for formation of dye carrying layers with the following compositions were prepared. In the cyan and yellow ink compositions, insolubles were removed by dissolving the components before filtration. These were applied in a dried coating amount of 1.0 g/m$^2$ respectively on polyethylene terephthalate films with a thickness of 4.5 $\mu$m the back surfaces of which had been subjected to heat-resistant treatment and then dried to obtain the respective heat transfer sheets of the three colors of cyan, magenta and yellow of the present invention.

| | |
|---|---|
| Cyan color | |
| Kayaset Blue 714 | 5.00 parts |
| Polybutyral resin | 3.92 parts |
| Methyl ethyl ketone | 22.54 parts |
| Toluene | 50.18 parts |
| Methyl isobutyl ketone | 13.00 parts |
| Xylene | 5.00 parts |

-continued

| | |
|---|---|
| Magenta color | |
| MS Red G | 2.60 parts |
| Macrolex Red Violet R | 1.40 parts |
| Polybutyral resin | 4.32 parts |
| Methyl ethyl ketone | 43.34 parts |
| Toluene | 43.34 parts |
| n-Propanol | 5.00 parts |
| Yellow color | |
| Foron Brilliant Yellow S-6GL (containing dispersing agent) | 5.50 parts |
| Polybutyral resin | 4.52 parts |
| Methyl ethyl ketone | 48.49 parts |
| Toluene | 41.49 parts |

Next, by the use of a synthetic paper (YUPO FPG #150, produced by Oji Yuka) as the substrate sheet, a coating solution with the following composition was applied on one surface of the paper in a quantity of 10 g/m$^2$ on drying and dried at 100° C. for 30 minutes to obtain a transferable material (image receiving sheet).

| | |
|---|---|
| Polyester resin (Vylon 200, produced by Toyobo) | 11.5 parts |
| Vinyl chloride-vinyl acetate copolymer (VYHH, produced by UCC) | 5.0 parts |
| Amino-modified silicone oil (KF-393, produced by Shinetsu Kagaku Kogyo) | 1.2 parts |
| Epoxy-modified silicone oil (X-22-343, produced by Shinetsu Kagaku Kogyo) | 1.2 parts |
| Methyl ethyl ketone/toluene/cyclohexanone (weight ratio 4:4:2) | 102 parts |

The heat transfer sheets of the three colors of the present invention as described above and the heat transferable material were respectively superposed on one another with each dye carrying layer and the dye receiving surface being opposed to each other, and recording with a thermal head was performed from the back surface of the heat transfer sheet under the conditions of a heat application voltage of 10 V and a printing time of 4.0 msec. to obtain images of three colors. The color rendering properties of these images of three colors were compared with the corrected printed images with the standard colors of off-set printing ink (G set ink, produced by Moroboshi Ink), and good coincidence was confirmed.

EXAMPLE B-2

A heat transfer sheet for color image formation shaped in a continuous sheet of the present invention having the three colors juxtaposed successively on a continuous sheet was obtained as in Example B-1 except that the inks for formation of dye carrying layers of three colors were coated in the order of cyan, magenta and yellow respectively over a constant area on one sheet of a continuous sheet (the same substrate as in Example B-1).

Figure 7:
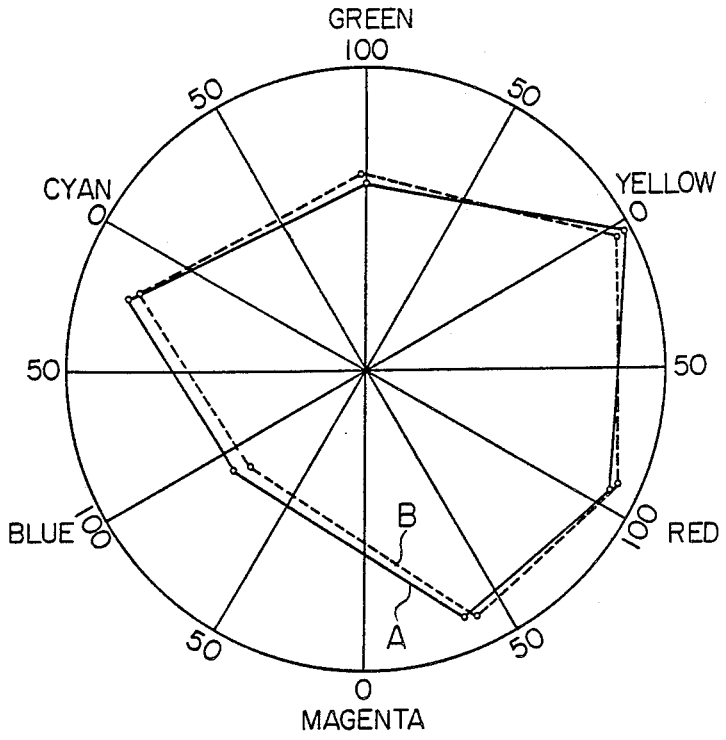
FIG. 7 is a color circle which was prepared on the basis of the system of GATF from the values obtained by measuring the densities with filters of blue violet, green and red by use of a reflective densitometer (Macbeth RD-918) of the color image (A) according to the present invention obtained in Example B-2 and the color image (B) by the standard off-set ink, respectively.
Figure 8:
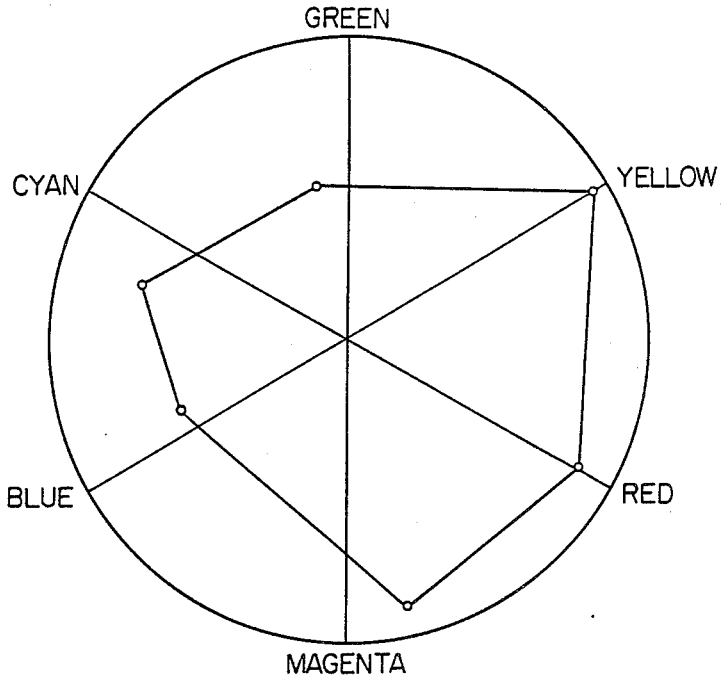
FIGS. 8 to 25 are color circles prepared according to the same method as in the above FIG. 7 in Examples C-1 to C-7, and Comparative Examples 1 to 11, respectively.
Figure 9:
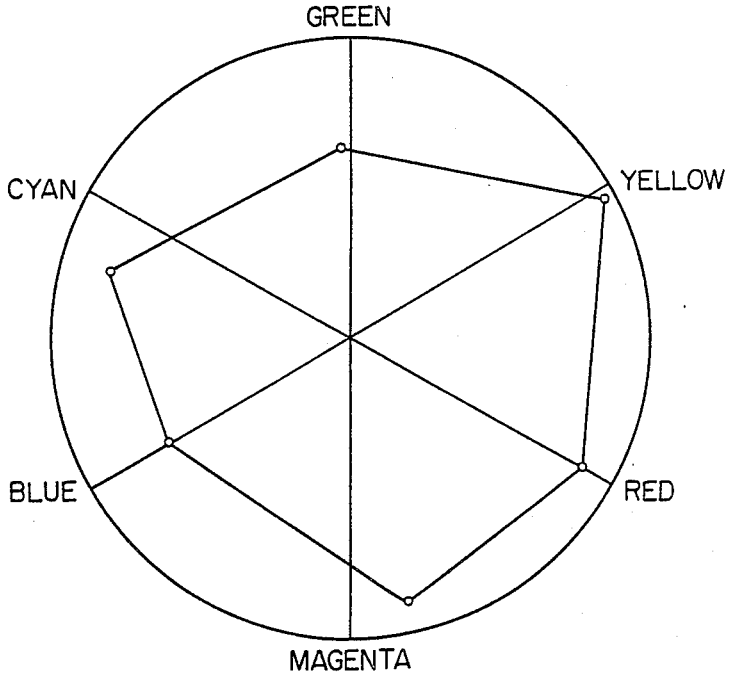
Figure 10:
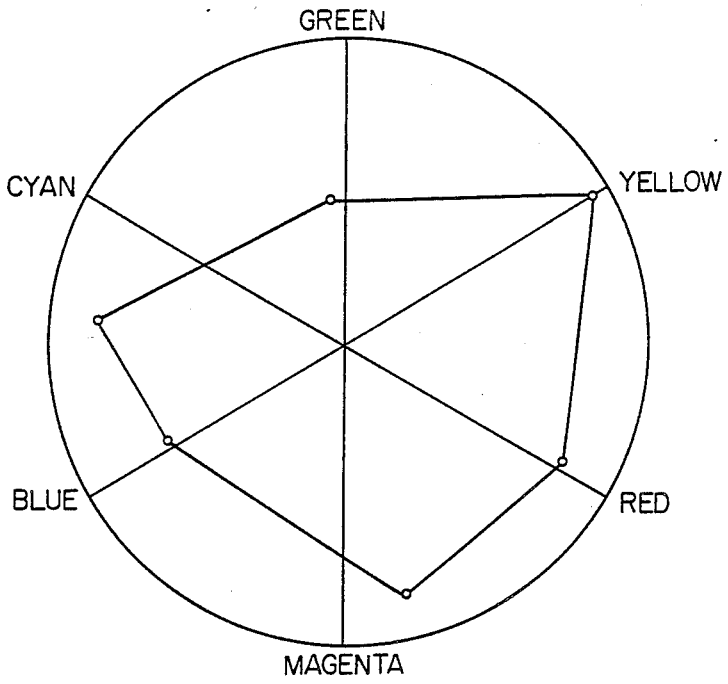
Figure 11:
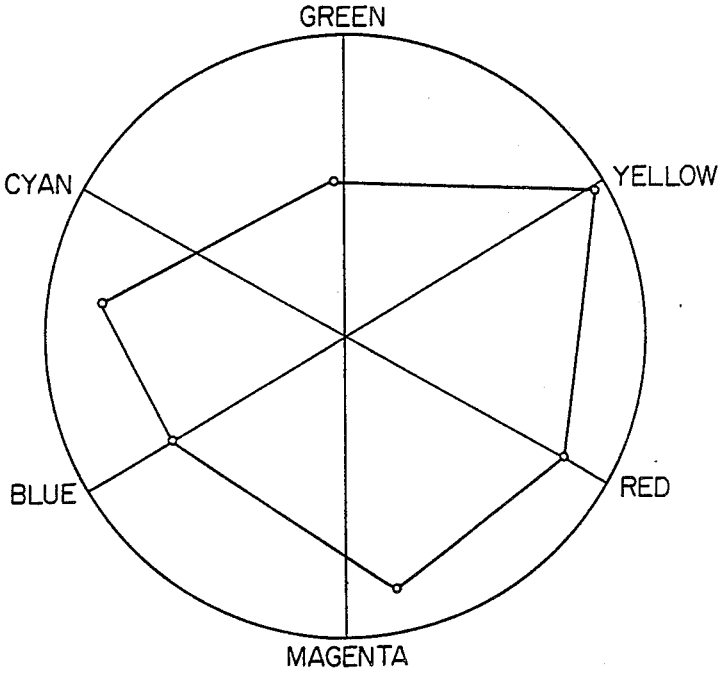
Figure 12:
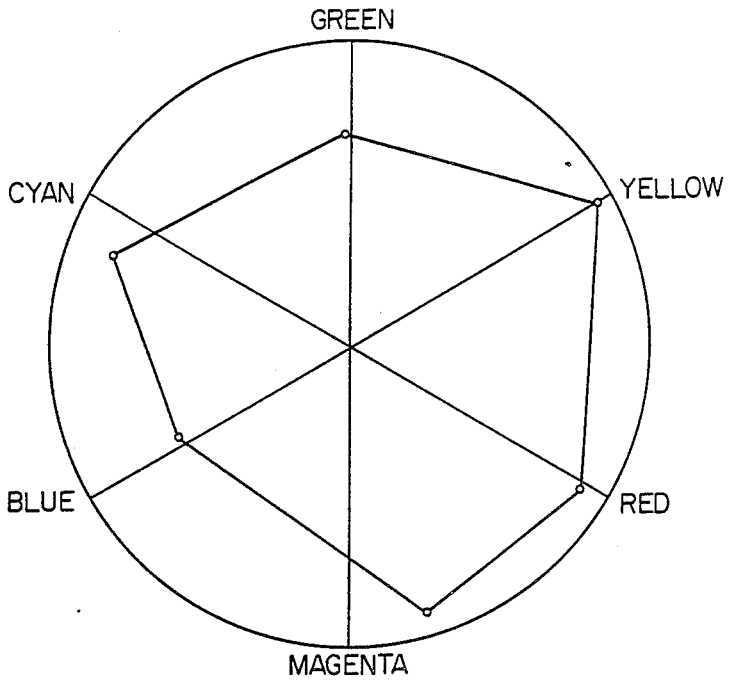
Figure 13:
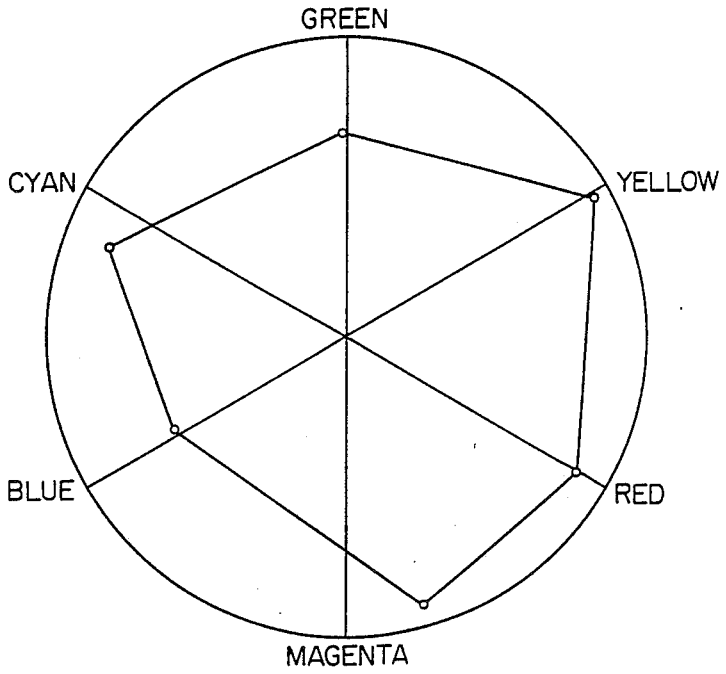
Figure 14:
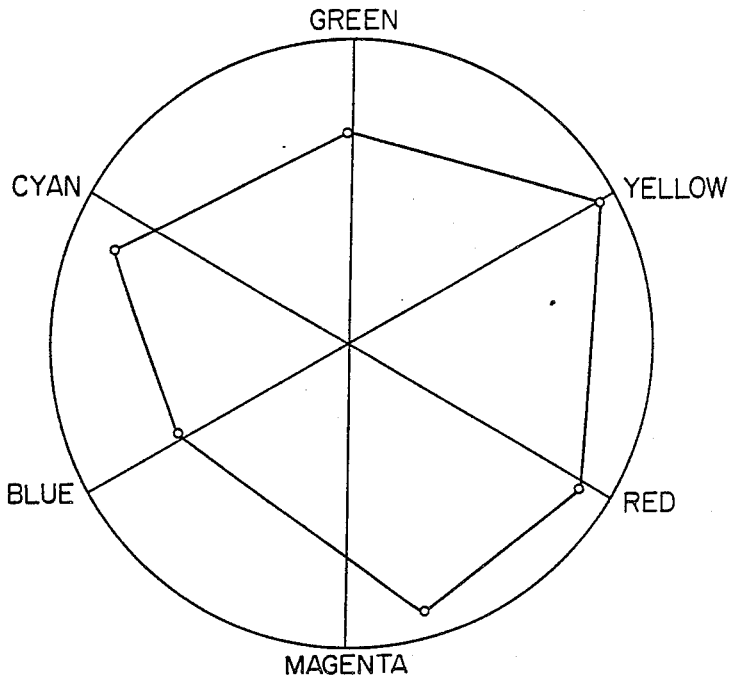
Figure 15:
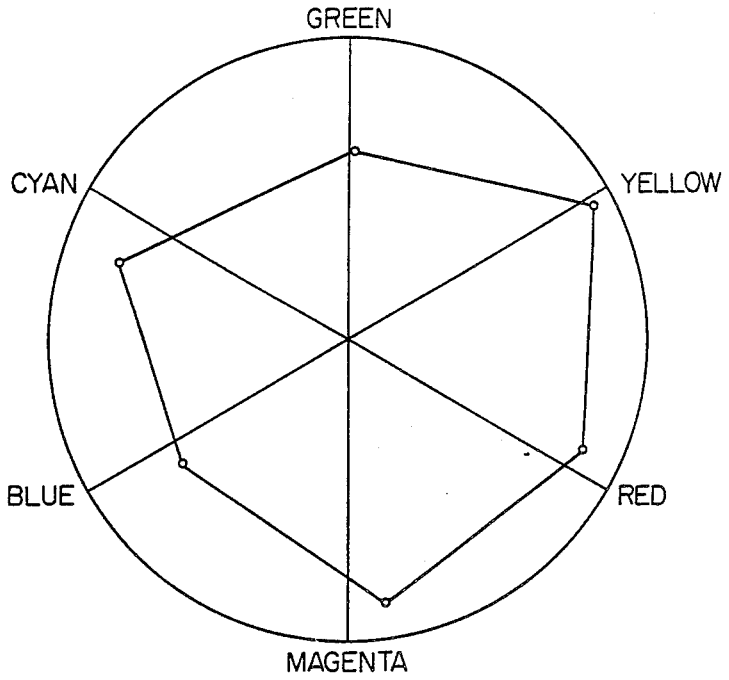
Figure 16:
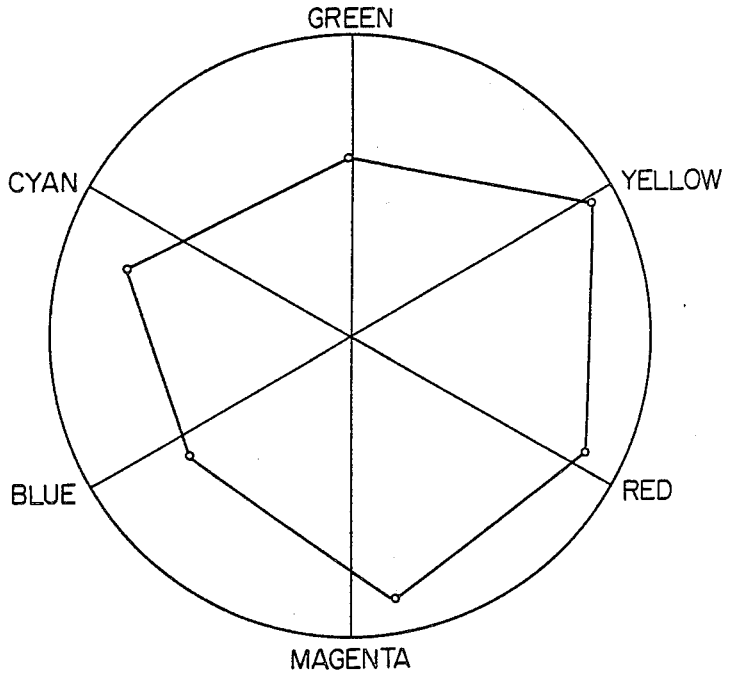
Figure 17:
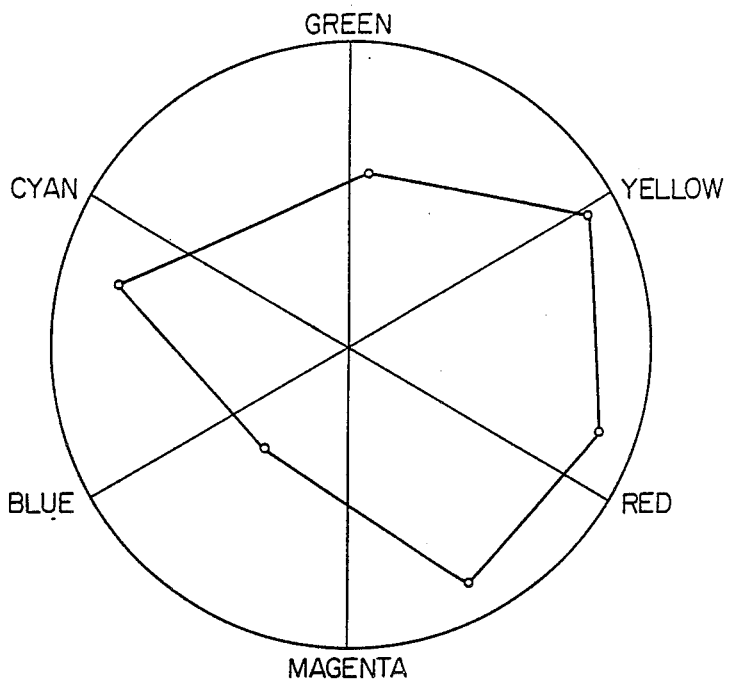
Figure 18:
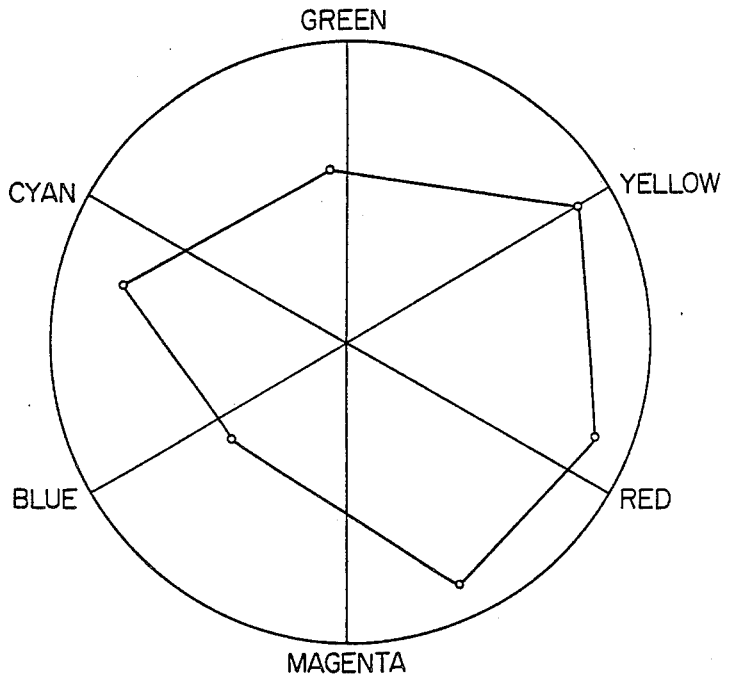
Figure 19:
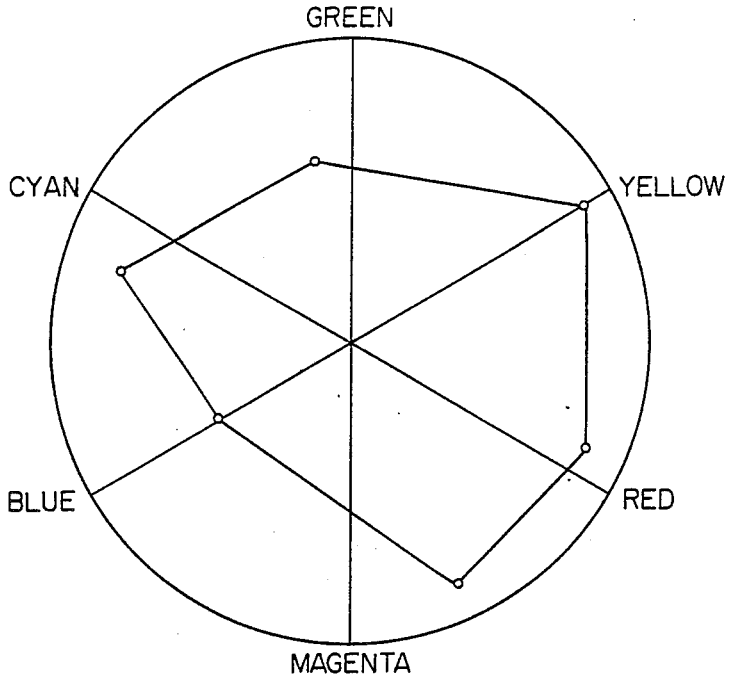
Figure 20:
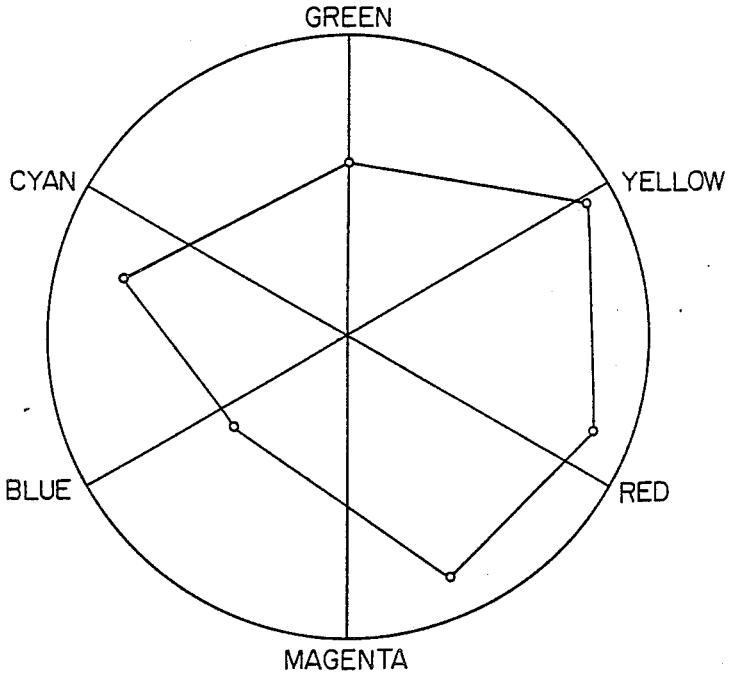
Figure 21:
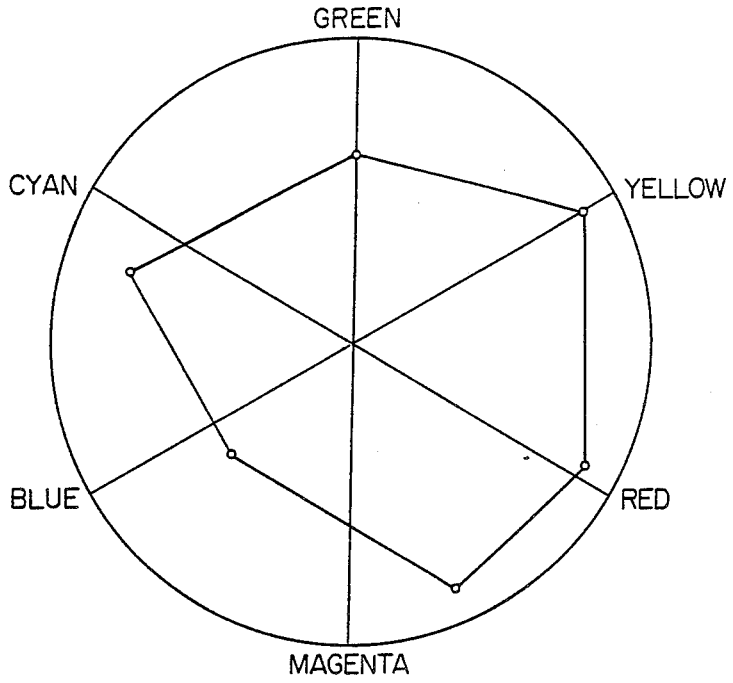
Figure 22:
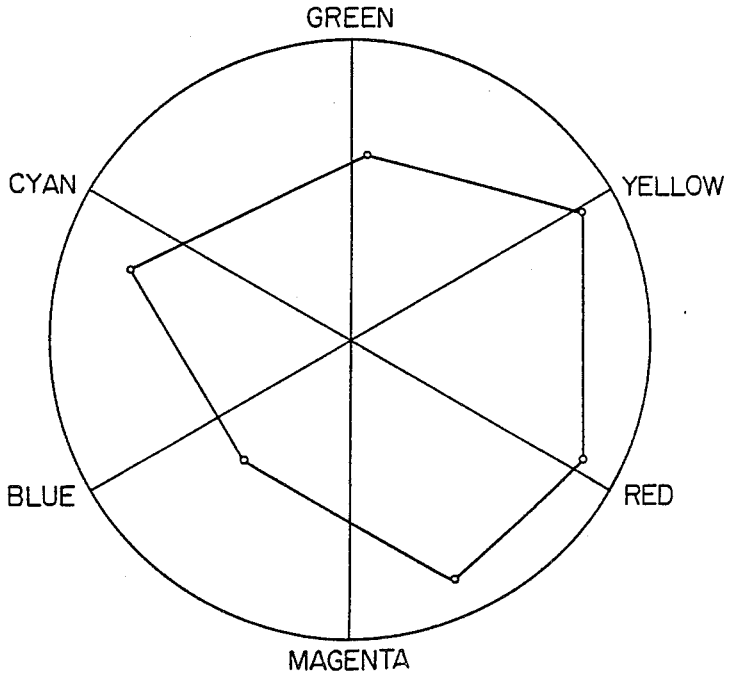
Figure 23:
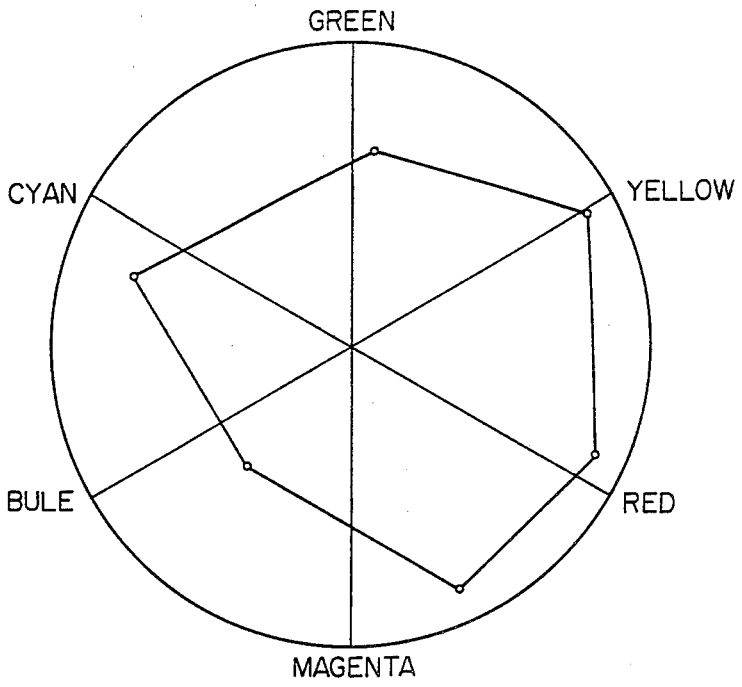
Figure 24:
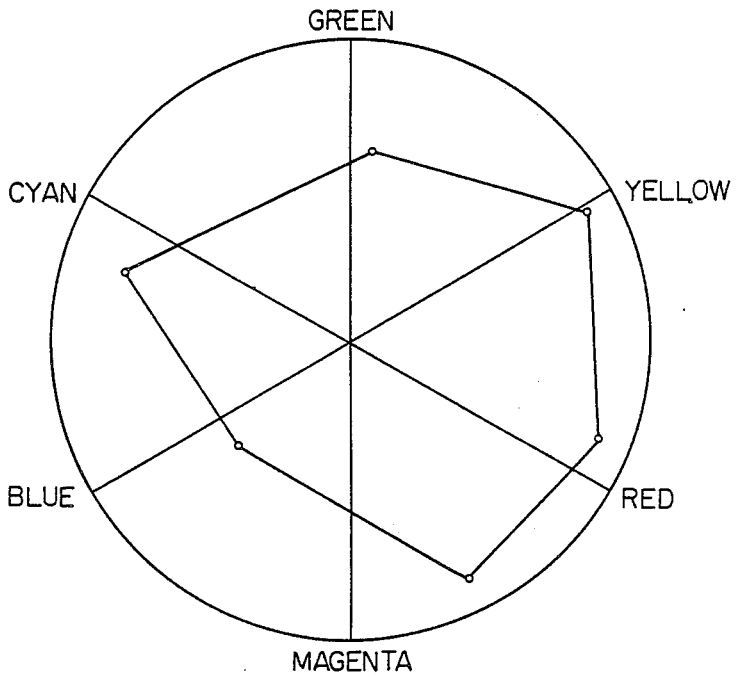
Figure 25:
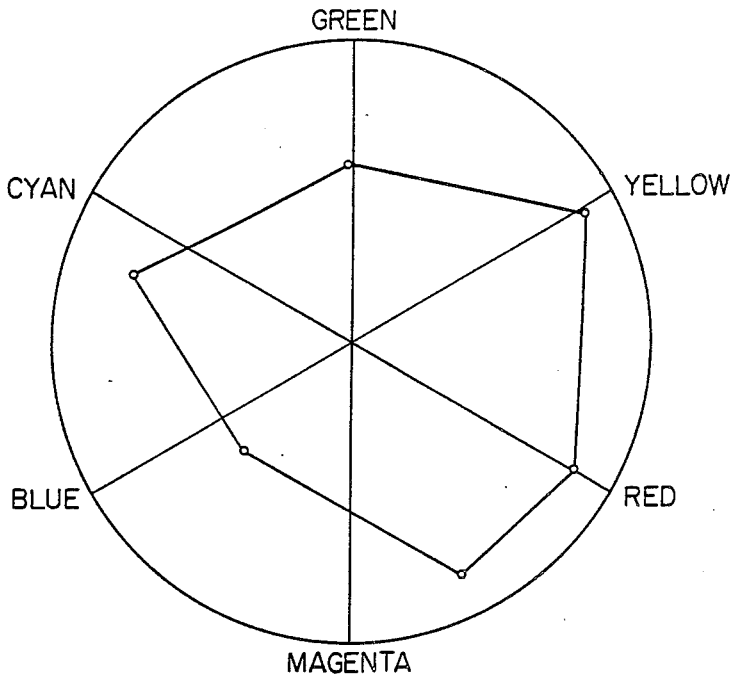

By the use of the heat transfer sheet, heat transfer was performed continuously as in Example B-1 in the order of cyan, magenta and yellow to form color images. On the other hand, for comparison, by the use of the standard off-set ink (G set ink, produced by Moroboshi Ink), the color images were formed from the same original manuscript by a correction printer and compared with the above color images. As a result, discrimination was impossible with naked eyes, and the color rendering properties of these two kinds of color images were as shown in FIG. 7.

EXAMPLES C-1 to C-12

Ink compositions for formation of dye carrying layers shown in the following Tables C-1 to C-12 were prepared. Each ink composition was applied on the surface of a polyethylene terephthalate film with a thickness of 4.5 μm the back surface of which had been subjected to heat-resistant treatment and dried to obtain a heat transfer sheet having a dye carrying layer of each color formed thereon. As the above heat transfer sheet, a sheet having a dye carrying layer of black formed thereon was also prepared. As the black ink composition, those shown in the Tables C-13 to C-16 shown below were used.

Next, as the image receiving sheet, a synthetic paper (YUPO FPG-150, produced by Oji Yuka) was used as the substrate, and a coating solution comprising the composition for formation of image receiving layer shown below was applied on one surface thereof in a quantity of 10.0 g/m$^2$ on drying and dried at 100° C. for 30 minutes.

| Composition for formation of image receiving layer | |
|---|---|
| Polyester resin (Vylon 600, produced by Toyobo) | 3 parts |
| Vinyl chloride-vinyl acetate copolymer (VAGH, produced by UCC) | 6 parts |
| Vinyl chloride-vinyl acetate copolymer (VYHH, produced by UCC) | 1 part |
| Amino-modified silicone oil (KF-393, produced by Shinetsu Kagaku Kogyo) | 0.7 part |
| Epoxy-modified silicone oil (X-22-343, produced by Shinetsu Kagaku Kogyo) | 0.7 part |
| Methyl ethyl ketone | 20 parts |
| Toluene | 20 parts |

Next, each of the above heat transfer sheet and the above image receiving sheet were superposed on one another so that each dye carrying layer and the dye receiving surface opposed each other, and recording was performed with a thermal head from the back surface of the heat transfer sheet under the conditions of a head application voltage of 12.0 V, a printing time of 16.0 msec/line and a running speed of 33.3 msec/line.

For the images obtained, hue error and turbidity were measured by the use of a reflective densitometer (Macbeth RC-918). The measurement results are shown in the following Tables C-1 to C-12.

Also, for Examples C-1 to C-7, the color rendering properties of the images obtained are shown in FIGS. 8 to 14 by use of color circles based on GATF.

On the other hand, for comparison, the color rendering properties of various off-set printing inks are shown similarly in FIGS. 15 to 25 (Comparative Examples 1 to 11). By comparison of these, it can be understood that the color reproducibility of the color image obtained by the heat transfer sheet of the present invention is comparable with that of off-set printing inks.

Particularly, the color rendering properties of Examples C-2, C-5, C-6, C-7 are very good, and the color images formed by these heat transfer sheets exhibited color reproducibilities which were even indiscriminable by naked eye when compared with the color images formed from the same original manuscript by a correction printer by the use of off-set ink for correction (e.g., NS2C correction ink, produced by Moroboshi Ink).

The off-set inks employed as Comparative Examples are as follows.

| | | |
|---|---|---|
| Comparative Example | 1 | produced by PANTONE (U.S.A.) |
| " | 2 | produced by Sun Chemical Co. (U.S.A.) |
| " | 3 | produced by K & E Co. (Germany) |
| " | 4 | produced by Hartmann Co. (Swiss) |
| " | 5 | produced by Collie Co. (Australia) |
| " | 6 | produced by Canada Printing Ink Co. (Canada) |
| " | 7 | Best One Ink, produced by Toka Shikiso |
| " | 8 | CAPS G Ink, produced by Dainippon Ink |
| " | 9 | TK Bright ink for correction, produced by Toyo Ink |
| " | 10 | NS 2C ink for correction, produced by Moroboshi Ink |
| " | 11 | BW Shuttle Ink, produced by Toka Shikiso |

TABLE C-1

(Example C-1)

| Color | Cyan | | Magenta | | Yellow | |
|---|---|---|---|---|---|---|
| Ink Composition | Kayaset Blue 714 | 5.00 (parts) | MS Red G | 2.60 (parts) | Foron Brilliant Yellow S-6GL (including dispersing agent) | 5.50 (parts) |
| | Polyvinylbutyral resin | 3.92 | Macrolex Red Violet R | 1.40 | Polyvinylbutyral resin | 4.52 |
| | Methyl ethyl ketone | 22.54 | Polyvinylbutyral resin | 4.32 | Methyl ethyl ketone | 48.49 |
| | Toluene | 50.18 | Methyl ethyl ketone | 43.34 | Toluene | 41.49 |
| | Methyl isobutyl ketone | 13.00 | Toluene | 43.34 | | |
| | Xylene | 5.00 | n-propanol | 5.00 | | |
| Hue hue error | 23.4% | | 23.2% | | 0.8% | |
| turbidity | 31.3% | | 8.7% | | 3.6% | |

TABLE C-2

(Example C-2)

| Color | Cyan | | Magenta | | Yellow | |
|---|---|---|---|---|---|---|
| Ink Composition | Kayaset Blue 714 | 1.00 (parts) | MS Red G | 2.86 (parts) | Foron Brilliant Yellow S-6GL (including dispersing agent) | 6.00 (parts) |

TABLE C-2-continued (Example C-2)

| Color | | Cyan | | Magenta | | Yellow | |
|---|---|---|---|---|---|---|---|
| | | Foron Brilliant Blue S-R (including dispersing agent) | 4.80 | Macrolex Red Violet R Polyvinylbutyral resin | 1.56 4.32 | Polyvinylbutyral resin Methyl ethyl ketone | 4.52 43.99 |
| | | Polyvinylbutyral | 4.60 | Methyl ethyl ketone | 43.34 | Toluene | 40.99 |
| | | Methyl ethyl ketone | 44.80 | Toluene | 42.92 | Cyclohexanone | 4.50 |
| | | Toluene | 44.80 | Cyclohexanone | 5.0 | | |
| Hue | hue error | 27.4% | | 20.6% | | 1.6% | |
| | turbidity | 19.1% | | 10.2% | | 3.2% | |

TABLE C-3

(Example C-3)

| Color | | Cyan | | Magenta | | Yellow | |
|---|---|---|---|---|---|---|---|
| Ink Composition | | Waxoline Blue AP-FW | 6.05 (parts) | MS Red G | 2.40 (parts) | PTY-52 | 5.50 (parts) |
| | | Kayaset Blue 714 | 1.65 | Ceres Red 7B | 3.10 | Polyvinylbutyral resin | 4.80 |
| | | Polyvinylbutyral resin | 5.12 | Polyvinylbutyral resin | 4.80 | Methyl ethyl ketone | 55.00 |
| | | Methyl ethyl ketone | 29.44 | Methyl ethyl ketone | 44.85 | Toluene | 34.70 |
| | | Toluene | 43.84 | Toluene | 44.85 | Microfine MF-8F | 2.06 |
| | | Methyl isobutyl ketone | 10.00 | Microfine MF-8F | 2.06 | | |
| | | Microfine MF-8F | 2.56 | | | | |
| Hue | hue error | 39.0% | | 25.2% | | 1.0% | |
| | turbidity | 19.4% | | 14.0% | | 3.0% | |

TABLE C-4

(Example C-4)

| Color | | Cyan | | Magenta | | Yellow | |
|---|---|---|---|---|---|---|---|
| Ink Composition | | Waxoline Blue AP-FW | 6.0 (parts) | Ceres Red 7B | 5.0 (parts) | Foron Brilliant Yellow S-6GL (including dispersing agent) | 4.5 (parts) |
| | | Kayaset Blue 714 | 3.0 | MS Red G | 2.0 | PTY-52 | 1.5 |
| | | Polyvinylacetal resin | 3.5 | Polyvinylacetal resin | 3.5 | Polyvinylacetal resin | 3.5 |
| | | Methyl ethyl ketone | 43.75 | Methyl ethyl ketone | 44.75 | Methyl ethyl ketone | 45.25 |
| | | Toluene | 53.75 | Toluene | 44.75 | Toluene | 45.25 |
| | | Microfine MF-8F | 0.42 | Microfine MF-8F | 0.35 | | |
| Hue | hue error | 35.6% | | 20.3% | | 1.3% | |
| | turbidity | 19.6% | | 14.6% | | 3.2% | |

TABLE C-5

(Example C-5)

| Color | | Cyan | | Magenta | | Yellow | |
|---|---|---|---|---|---|---|---|
| Ink Composition | | Foron Brilliant Blue S-R (including dispersing agent) | 6.75 (parts) | the above magenta No. 3 | 5.4 (parts) | Foron Brilliant Yellow S-6GL (including dispersing agent) | 7.0 (parts) |
| | | | | Macrolex Red Violet R | 0.69 | | |
| | | the above cyan No. 3 | 3.00 | Foron | | Polyvinylbutyral resin | 4.00 |
| | | Polyvinylbutyral resin | 4.24 | Brilliant Yellow S-6GL (including dispersing agent) | 0.09 | Methyl ethyl ketone | 52.8 |
| | | Methyl ethyl ketone | 46.33 | Polyvinylbutyral resin | 4.40 | Toluene | 36.2 |
| | | Toluene | 39.68 | Methyl ethyl ketone | 45.3 | Microfine MF-8F | 0.7 |
| | | Microfine MF-8F | 0.8 | Toluene | 14.1 | | |
| | | | | Microfine MF-8F | 6.0 | | |
| Hue | hue error | 14.2% | | 28.9% | | 1.5% | |
| | turbidity | 17.2% | | 7.2% | | 3.7% | |

TABLE C-6

(Example C-6)

| Color | Cyan | Magenta | Yellow | |
|---|---|---|---|---|
| Ink Composition | the same as in Example C-5 | the same as in Example C-5 | Foron Brilliant Yellow S-6GL (including dispersing | 6.68 (parts) |

TABLE C-6-continued

| Color | Cyan | (Example C-6) Magenta | Yellow |
|---|---|---|---|
| | | agent) | |
| | | Foron Brilliant Scarlet S-RL (including dispersing agent) | 0.09 |
| | | Polyvinylbutyral resin | 4.00 |
| | | Methyl ethyl ketone | 52.8 |
| | | Toluene | 36.4 |
| | | Microfine MF-8F | 0.7 |
| Hue hue error | | 1.9% | |
| turbidity | | 4.4% | |

TABLE C-7

| Color | (Example C-7) Cyan | | Magenta | Yellow |
|---|---|---|---|---|
| Ink Composi-tion | Foron Brilliant Blue S-R (including dispersing agent) | 4.5 (parts) | the same as in Example C-5 | the same as in Example C-5 |
| | the above cyan No. 4 | 3 | | |
| | Polyvinylacetal resin | 3.5 | | |
| | Methyl ethyl ketone | 44.5 | | |
| | Toluene | 44.5 | | |
| | Microfine MF-8F | 0.24 | | |
| Hue hue error | 19.6% | | | |
| turbidity | 15.2% | | | |

TABLE C-8

| Color | (Example C-8) Cyan | | Magenta | Yellow |
|---|---|---|---|---|
| Ink Composi-tion | HM-1354 | 4.0 (parts) | the same as in Example C-5 | the same as in Example C-5 |
| | Polyvinylacetal resin | 3.5 | | |
| | Methyl ethyl ketone | 46.25 | | |
| | Toluene | 46.25 | | |
| Hue hue error | 16.8% | | | |
| turbidity | 23.1% | | | |

TABLE C-9

| Color | (Example C-9) Cyan | | Magenta | | Yellow |
|---|---|---|---|---|---|
| Ink Composi-tion | the above cyan No. 5 | 4.0 (parts) | the above magenta No. 4 | 3.0 (parts) | the same as in Example C-1 |
| | Polyvinylacetal resin | 3.5 | Polyvinylacetal resin | 3.5 | |
| | Methyl ethyl ketone | 46.25 | Methyl ethyl ketone | 46.75 | |
| | Toluene | 46.25 | Toluene | 46.75 | |
| Hue hue error | 31.8% | | 23.9% | | |
| turbidity | 20.7% | | 10.2% | | |

TABLE C-10

| Color | (Example C-10) Cyan | | Magenta | | Yellow |
|---|---|---|---|---|---|
| Ink Composi-tion | the above cyan No. 3 | 4.5 (parts) | Macrolex Red Violet R | 4.0 (parts) | the same as in Example C-1 |
| | Polyvinylacetal resin | 3.5 | Polyvinylacetal resin | 3.5 | |
| | Methyl ethyl ketone | 46.0 | Methyl ethyl ketone | 46.25 | |
| | Toluene | 46.0 | Toluene | 46.25 | |
| Hue hue error | 1.0% | | 3.1% | | |
| turbidity | 26.1% | | 15.1% | | |

TABLE C-11

| Color | (Example C-11) Cyan | | Magenta | | Yellow |
|---|---|---|---|---|---|
| Ink Composi-tion | MS Blue 100 | 4.5 (parts) | Palanil Red 3GL | 5.0 (parts) | the same as in Example C-1 |
| | Polyvinylacetal resin | 3.5 | Polyvinylacetal resin | 3.5 | |
| | Methyl ethyl ketone | 46.0 | Methyl ethyl ketone | 45.75 | |
| | Toluene | 46.0 | Toluene | 45.75 | |
| Hue hue error | 52.4% | | 55.1% | | |
| turbidity | 14.2% | | 4.5% | | |

TABLE C-12

| Color | | Cyan | (Example C-12) Magenta | | Yellow |
|---|---|---|---|---|---|
| Ink Composition | | the same as in Example C-1 | Foron Brilliant Scarlet S-RL (including dispersing agent) | 6.5 (parts) | the same as in Example C-1 |
| | | | Polyvinylacetal resin | 3.5 | |
| | | | Methyl ethyl ketone | 45.0 | |
| | | | Toluene | 45.0 | |
| Hue | hue error | | 56.5% | | |
| | turbidity | | 5.2% | | |

TABLE C-13

| Color | | Cyan | | (Example C-13) Magenta | | Yellow | |
|---|---|---|---|---|---|---|---|
| Ink Composition | | Kayaset Blue 714 | 5 (parts) | MS Red G | 2.6 (parts) | Foron Brilliant Yellow S-6GL (powder) | 2.0 (parts) |
| | | Polyvinylacetal resin | 2.9 | Macrolex Red Violet R | 1.4 | Macrolex Yellow S-6G | 3.5 |
| | | Polyvinylbutyral resin | 0.3 | Polyvinylacetal resin | 2.9 | Polyvinylacetal resin | 3.0 |
| | | Methyl ethyl ketone | 45.9 | Polyvinylbutyral resin | 0.3 | Polyvinylbutyral resin | 2.5 |
| | | Toluene | 45.9 | Methyl ethyl ketone | 46.4 | Methyl ethyl ketone | 44.5 |
| | | Microfine MF-8F | 0.25 | Toluene | 46.4 | Toluene | 44.5 |
| | | | | Microfine MF-8F | 0.22 | | |
| Hue | hue error | 23.4% | | 23.4% | | 1.2% | |
| | turbidity | 31.3% | | 9.0% | | 3.4% | |

TABLE C-14

| Color | | Cyan | | (Example C-14) Magenta | | Yellow | |
|---|---|---|---|---|---|---|---|
| Ink Composition | | Waxoline Blue AP-FW | 3.0 (parts) | MS Red G | 1.08 (parts) | Foron Brilliant Yellow S-6GL (powder) | 1.75 (parts) |
| | | Kayaset Blue 714 | 4.6 | Macrolex Red Violet R | 2.59 | Macrolex Yellow S-6G | 3.05 |
| | | Polyvinylacetal resin | 3.33 | Polyvinylacetal resin | 3.33 | Polyvinylacetal resin | 3.0 |
| | | Polyvinylbutyral resin | 0.27 | Polyvinylbutyral resin | 0.27 | Polyvinylbutyral resin | 2.5 |
| | | Methyl ethyl ketone | 44.4 | Methyl ethyl ketone | 46.365 | Methyl ethyl ketone | 44.85 |
| | | Toluene | 44.4 | Toluene | 46.365 | Toluene | 44.85 |
| | | Microfine MF-8F | 0.34 | Microfine MF-8F | 0.27 | Microfine MF-8F | 0.31 |
| Hue | hue error | 31.4% | | 18.8% | | 1.4% | |
| | turbidity | 25.0% | | 13.6% | | 0.9% | |

TABLE C-15

| Color | | Cyan | (Example C-15) Magenta | | Yellow | |
|---|---|---|---|---|---|---|
| Ink Composition | | the same as in Example C-5 | DO-5-10 | 1.3 (parts) | Foron Brilliant Yellow S-6GL (powder) | 3.0 (parts) |
| | | | Samaron Red HBSL | 1.3 | Polyvinylacetal resin | 3.2 |
| | | | Macrolex Red Violet R | 1.4 | Methyl ethyl ketone | 46.9 |
| | | | Polyvinylacetal resin | 3.5 | Toluene | 46.9 |
| | | | Methyl ethyl ketone | 46.25 | | |
| | | | Toluene | 46.25 | | |
| | | | Microfine MF-8F | 0.23 | | |
| Hue | hue error | | 23.6% | | 1.4% | |
| | turbidity | | 9.1% | | 3.7% | |

TABLE C-16

| Color | | Cyan | | (Example C-16) Magenta | | Yellow |
|---|---|---|---|---|---|---|
| Ink Composition | | Kayaset Blue 714 | 2.2 (parts) | MS Red G | 2.6 (parts) | the same as in Example C-1 |
| | | Foron Brilliant Blue S-R (including dispersion agent) | 3.3 | Macrolex Red Violet R | 2.8 | |

TABLE C-16-continued

| Color | | Cyan (Example C-16) | | Magenta (Example C-16) | | Yellow (Example C-16) |
|---|---|---|---|---|---|---|
| | | Polyvinylacetal resin | 3.83 | Polyvinylacetal resin | 3.83 | |
| | | Methyl ethyl ketone | 45.335 | Methyl ethyl ketone | 45.385 | |
| | | Toluene | 45.335 | Toluene | 45.385 | |
| | | | | Microfine MF-8F | 0.60 | |
| Hue | hue error | 22.4% | | 17.0% | | |
| | turbidity | 22.2% | | 11.8% | | |

TABLE C-17

| | Black | |
|---|---|---|
| Ink Composition | Waxoline Blue AP-FW | 3.6 |
| | Ceres Red 7B | 2.1 |
| | Foron Brilliant Yellow S-6GL (including dispersing agent) | 2.0 |
| | Polyvinylbutyral resin | 3.93 |
| | Methyl ethyl ketone | 44.19 |
| | Toluene | 44.19 |
| | Polyethylene wax (Microfine MF-8F) | 0.5 |

TABLE C-18

| | Black | |
|---|---|---|
| Ink Composition | the above cyan No. 9 | 3.05 |
| | Ceres Red 7B | 1.80 |
| | Foron Brilliant Yellow S-6GL (powder) | 2.15 |
| | Polyvinylbutyral resin | 3.5 |
| | Methyl ethyl ketone | 46.5 |
| | Toluene | 46.5 |
| | Polyethylene wax (Microfine MF-8F) | 0.21 |

TABLE C-19

| | Black | |
|---|---|---|
| Ink Composition | DHK 996 | 4.6 |
| | Ceres Red 7B | 2.4 |
| | Foron Brilliant Yellow S-6GL (powder) | 1.0 |
| | Polyvinylbutyral resin | 3.5 |
| | Methyl ethyl ketone | 44.25 |
| | Toluene | 44.25 |
| | Polyethylene wax (Microfine MF-8F) | 0.35 |

TABLE C-20

| | Black | |
|---|---|---|
| Ink Composition | DAITO Blue No. 1 | 3.41 |
| | Sumikaron Rubine SEGL | 2.0 |
| | PTY 52 | 0.82 |
| | Polyvinylbutyral resin | 4.4 |
| | Methyl ethyl ketone | 44.8 |
| | Toluene | 44.8 |
| | Polyethylene wax (Microfine MF-8F) | 0.7 |

EXAMPLES D-1 TO D-5

An ink composition for formation of a dye carrying layer of the composition shown below was prepared and applied on a polyethylene terephthalate film of a thickness of 4.5 μm the back surface of which had been subjected to heat-resistant treatment in a dried coating amount of 1.0 g/m$^2$ and then dried to obtain a heat transfer sheet of the present invention.

| | |
|---|---|
| Dye in Table D-1 shown below | 3 parts |
| Polyvinylbutyral resin | 4.5 parts |
| Methyl ethyl ketone | 46.25 parts |

-continued

| | |
|---|---|
| Toluene | 46.25 parts |

Next, by the use of a synthetic paper (YUPO FPG #150, produced by Oji Yuka) as the substrate sheet, a coating solution of the composition shown below was applied on one surface thereof in a quantity of 10 g/m$^2$ on drying and dried at 100° C. for 30 minutes to obtain a transferable material.

| | |
|---|---|
| Polyester resin (Vylon 200, produced by Toyobo) | 11.5 parts |
| Vinyl chloride-vinyl acetate copolymer (VYHH, produced by UCC) | 5.0 parts |
| Amino-modified silicone oil (KF-393, produced by Shinetsu Kagaku Kogyo) | 1.2 parts |
| Epoxy-modified silicone oil (X-22-343, produced by Shinetsu Kagaku Kogyo) | 1.2 parts |
| Methyl ethyl ketone/toluene/cyclohexanone (4:4:2) | 102 parts |

The above heat transfer sheet and the above heat transfer material were superposed on one another with the respective dye carrying layer and dye receiving surface opposed to each other, and recording was performed with a thermal head from the back surface of the heat transfer sheet under the conditions of a head application voltage of 10 V and a printing time of 4.0 msec., to obtain the results shown below in Table D-1.

TABLE D-1

| | Example | | | | |
|---|---|---|---|---|---|
| Dye | D-1 I | D-2 II | D-3 III | D-4 IV | D-5 V |
| Color formed density | 1.32 | 0.59 | 0.88 | 0.90 | 0.84 |
| Fastness | ○ | ○ | ◎ | ◎ | ○ |
| Tone | Indigo | Indigo | Indigo | Indigo | Indigo |

The dye I is the dye of the above formula (I), wherein A=—CONHR$_4$, R$_4$=n-butyl group, R$_1$=hydrogen, R$_2$=ethyl group, R$_3$=ethyl group (I/O value=0.96, molecular weight 403).

The dye II is similarly the dye, wherein A=—CONHR$_4$, R$_4$=n-propyl group, R$_1$=methyl group, R$_2$=ethyl group, R$_3$=ethyl group (I/O value=0.96, molecular weight 403).

The dye III is similarly the dye, wherein A=—CONHR$_4$, R$_4$=n-butyl group, R$_1$=hydrogen, R$_2$=ethyl group, R$_3$=$C_2H_4NHSO_2CH_3$ (I/O value=1.39, molecular weight 495).

The dye IV is similarly the dye, wherein A=—CONHR$_4$, R$_4$=n-butyl group, R$_1$=methyl group, $R_2$=ethyl group, $R_3$=hydroxyethyl group (I/O value=1.12, molecular weight 433).

The dye V is similarly the dye, wherein A=—CONHR$_4$, $R_4$=n-propyl group, $R_1$=hydrogen, $R_2$=methyl group, $R_3$=methyl group (I/O value=1.10, molecular weight=361).

In all of the dyes, $X_1$ and $X_2$ are hydrogen atoms.

EXAMPLES D-6 TO D-8

In place of the dyes in Examples D-1 to D-5, the dyes with the substitutents in the above formula (II) as shown below were employed, the procedure in Examples D-1 to D-5 being otherwise followed, whereupon excellent results similarly as in Examples D-1 to D-6 were obtained.

TABLE D-2

| Substituent | Example D-6 | D-7 | D-8 |
|---|---|---|---|
| B | $CONHC_4H_9$ | $CONH_2$ | $NHCOC_4H_9$ |
| C | $NHCOCH_3$ | $NHC_4H_9$ | $NHCH_3$ |
| $R_1$ | $CH_3$ | H | H |
| $R_2$ | $C_2H_5$ | $C_2H_5$ | $C_2H_5$ |
| $R_3$ | $C_2H_5$ | $C_2H_4OH$ | $C_2H_4NHCH_3$ |
| $X_1$ | H | H | Cl |
| Molecular weight | 424 | 383 | 445.5 |
| I/O value | 1.33 | 1.45 | 1.17 |

EXAMPLES D-9 TO D-12

In place of the dyes in Examples D-1 to D-5, the above dyes were employed, otherwise the procedure in Examples D-1 to D-5 being followed, whereupon the results shown below in Table D-3 were obtained.

TABLE D-3

| Dye | Example D-9 I | D-10 II | D-11 III | D-12 IV |
|---|---|---|---|---|
| Color formed density | 2.07 | 0.56 | 2.06 | 1.11 |
| Fastness | ○ | ○ | ○ | ○ |
| Tone | Yellow | Red | Red | Indigo |

The dye I is the dye of the above formula (1).
The dye II is the dye of the above formula (3).
The dye III is the dye of the above formula (8).
The dye IV is the dye of the above formula (9).

EXAMPLE D-13

Example D-1 was repeated except that the composition of the ink for formation of the dye carrying layer was changed as follows.

| | |
|---|---|
| Dye of the above formula 13 | 3 parts |
| Polybutyral resin | 4.5 parts |
| Methyl ethyl ketone | 25.35 parts |
| Toluene | 25.35 parts |
| N,N-dimethylformamide | 43.80 parts |
| Color formed density: 1.21, fastness: ○ tone: scarlet | |

EXAMPLE D-14

Example D-13 was repeated except that the dye of the above formula 14 was used in place of the dye in Example D-13 to obtain the following results.

Color formed density: 1.26, fastness: ○ , tone: scarlet

EXAMPLES D-15 TO D-22

In place of the dyes in Examples D-1 to D-5, the above dyes were used, otherwise the procedure in Examples 1 to 5 being followed, whereupon the results shown below in Table D-4 were obtained.

TABLE D-4

| Dye | Example D-15 I | D-16 II | D-17 III | D-18 IV |
|---|---|---|---|---|
| Color formed density | 1.01 | 0.91 | 0.91 | 0.28 |
| Fastness | ○ | ○ | ○ | ○ |
| Tone | Violet | Violet | Green | Red |
| Dye | D-19 V | D-20 VI | D-21 VII | D-22 VIII |
| Color formed density | 0.40 | 0.48 | 1.12 | 0.88 |
| Fastness | ○ | ○ | ○ | ○ |
| Tone | Green | Yellow | Red | Black |

The dye I is the dye of the above formula (15).
The dye II is the dye of the above formula (16).
The dye III is the dye of the above formula (17).
The dye IV is the dye of the above formula (18).
The dye V is the dye of the above formula (19).
The dye VI is the dye of the above formula (10).
The dye VII is the dye of the above formula (11).
The dye VIII is the dye of the above formula (12).

EXAMPLES D-23 to D-27

Except for changing the composition of the ink for formation of the dye carrying layer as follows, Examples D-1 to D-5 were repeated to obtain the results shown below in Table D-5.

| | |
|---|---|
| The dye in Table-5 shown below | 1 part |
| Polyvinylbutyral resin | 4.5 parts |
| Methyl ethyl ketone | 25.35 parts |
| Toluene | 25.35 parts |
| Tetrahydrofuran | 43.80 parts |

TABLE D-5

| Dye | Example D-23 I | D-24 II | D-25 III | D-26 IV | D-27 V |
|---|---|---|---|---|---|
| Color formed density | 0.88 | 1.02 | 0.95 | 0.68 | 0.95 |
| Fastness | O | Δ | O | O | O |
| Tone | Indigo | Indigo | Indigo | Indigo | Indigo |

The dye I is the dye of the above formula (22).
The dye II is the dye of the above formula (23).
The dye III is the dye of the above formula (24).
The dye IV is the dye of the above formula (26).
The dye V is the dye of the above formula (27).

COMPARATIVE EXAMPLES D-1 TO D-7

Except for using the dyes shown below in Table 6 as the dyes in Examples D-1 to D-5, Example D-1 was repeated to obtain the results shown below in Table D-6.

TABLE D-6

| | Comparative Example | | | |
|---|---|---|---|---|
| Dye | D-1 I' | D-2 II' | D-3 III' | D-4 IV' |
| Color formed density | 1.76 | 0.66 | 1.03 | 0.40 |
| Fastness | Δ | Δ | X | Δ |
| Tone | Red | Violet | Bluish | Violet |
| Dye | D-5 V' | D-6 VI' | D-7 VII' | |
| Color formed density | 1.12 | 0.68 | 0.57 | |
| Fastness | X | Δ | Δ | |
| Tone | Yellow | Yellow | Indigo | |

The dye I' is Disperse Red 1 (I/O value=0.77, molecular weight 314).

The dye II' is Disperse Violet 1 (I/O value=1.34, molecular weight 238).

The dye III' is Disperse Violet 4 (I/O value=1.25, molecular weight 252).

The dye IV' is Disperse Violet 28 (I/O value=1.10, molecular weight 305).

The dye V' is Disperse Yellow 7 (I/O value=0.54, molecular weight 332).

The dye VI' is Disperse Yellow 23 (I/O value=0.57, molecular weight 318).

The dye VII' is Disperse Blue 26 (I/O value=1.80, molecular weight 298).

The color formed densities as described above are values measured by densitometer RD-918 produced by Macbeth Co. in U.S.A.

Fastness was measured by leaving the recorded images for a long time in an atmosphere of 50° C., and those without change in sharpness of image and without coloration of the white paper when the surface was rubbed with white paper were rated as ◎, those which had slightly lost sharpness and had slight coloration of the white paper as ○, those which had lost sharpness and coloration and had coloration of the white paper as Δ, and those with the images which had become unclear with marked coloration of the white paper as x.

Industrial Applicability

As described above, the heat transfer sheet for color image formation according to the present invention has excellent color reproducibility over a wide range and therefore can be utilized broadly, particularly in fields in which color images are required to be prepared simply and rapidly.

What is claimed is:

1. A heat transfer sheet for color image formation comprising respective dye carrying layers containing dyes with respective hues of cyan, magenta and yellow formed on a substrate sheet, characterized in that said respective dye carrying layers each contain one kind or plural kinds of dyes, and the color characteristics of said respective dye carrying layers satisfy the following conditions as the color characteristics (based on GATF) in a state of having been transferred on an image receiving sheet:

cyan:

hue error is in the range of from 10% on the green side to 60% on the blue side, and turbidity is 35% or less in the range of hue error from 10% on the green side to 45% on the blue side and is 20% or less in the range of hue error from 45% to 60% on the blue side;

magenta:

hue error is in the range of from 10% on the blue side to 60% on the red side, and turbidity is 25% or less in the range of hue error from 10% on the blue side to 35% on the red side and is 10% or less in the range of hue error from 35% to 60% on the red side;

yellow:

hue error is in the range of from 10% on the red side to 10% on the green side, and turbidity in this range is 10% or less.

2. A heat transfer sheet according to claim 1, wherein the hue error of cyan is in the range of from 5% or more and 30% or less on the blue side, and the turbidity in this range is 25% or less.

3. A heat transfer sheet according to claim 1, wherein the hue error of magenta is in the range of 15% or more and 35% or less on the red side, and the turbidity in this range is 15% or less.

4. A heat transfer sheet according to claim 1, wherein the hue error of yellow is in the range of within 5% on the red side and within 5% on the green side, and the turbidity in this range is 10% or less.

5. A heat transfer sheet according to claim 1, wherein the substrate sheet comprises one sheet, and the respective dye carrying layers of three colors are formed in any desired order on one surface on said substrate sheet.

6. A heat transfer sheet according to claim 1, wherein the dyes contained in the dye carrying layers each comprise a single kind of dye.

7. A heat transfer sheet according to claim 1, wherein the dyes contained in the dye carrying layers comprise a composite system of dyes of plural kinds in at least one of cyan, magenta or yellow.

8. A heat transfer sheet according to claim 1, wherein the inorganic/organic value (I/O value) of the dye contained in the dye carrying layer is 2.30 or less.

9. A heat transfer sheet according to claim 1, wherein the dye contained in the dye carrying layer has a molecular weight of 280 or more in all of cyan, magenta and yellow.

10. A heat transfer sheet according to claim 1, wherein the dye contained in the dye carrying layer has a molecular weight of 300 or more in all of cyan, magenta and yellow.

11. A heat transfer sheet according to claim 1, wherein the dye contained in the dye carrying layer has a molecular weight of 350 or more in all of cyan, magenta and yellow.

12. A heat transfer sheet according to claim 1, wherein the dye contained in the dye carrying layer has a melting point of 250° C. or lower.

13. A heat transfer sheet according to claim 1, wherein the dye contained in the dye carrying layer has a melting point of 80° to 200° C.

14. A heat transfer sheet according to claim 1, wherein a black dye carrying layer is further provided.

15. A heat transfer sheet for color image formation comprising respective dye carrying layers containing dyes with respective hues of cyan, magenta and yellow formed on a substrate sheet, wherein the inorganic/organic value (I/O value) of the dye is 2.30 or less, the dyes contained in the dye carrying layers have molecular weights of 280 or more and wherein said respective dye carrying layers each contain one kind or plural kinds of dyes, and the color characteristics of said respective dye carrying layers satisfy the following conditions as the color characteristics (based on GATF) in a state of having been transferred on an image receiving sheet:

cyan:

hue error is in the range of from 10% on the green side to 60% on the blue side, and turbidity is 35% or less in the range of hue error from 10% on the green side to 45% on the blue side and is 20% or less in the range of hue error from 45% to 60% on the blue side;

magenta:

hue error is in the range of from 10% on the blue side to 60% on the red side, and turbidity is 25% or less in the range of hue error from 10% on the blue side to 35% on the red side and is 10% or less in the range of hue error from 35% to 60% on the red side;

yellow:

hue error is in the range of from 10% on the red side to 10% on the green side, and turbidity in this range is 10% or less.

* * * * *